United States Patent [19]

Richardson

[11] Patent Number: 4,747,600

[45] Date of Patent: May 31, 1988

[54] ELECTRONIC GAMING BOARD FOR BINGO

[75] Inventor: John Richardson, San Diego, Calif.

[73] Assignee: Selectro-Vision, Ltd., San Diego, Calif.

[21] Appl. No.: 820,448

[22] Filed: Jan. 17, 1986

[51] Int. Cl.[4] ..... A63F 3/06

[52] U.S. Cl. ..... 273/269; 273/237; 273/138 A; 273/139

[58] Field of Search ..... 273/269, 237, 138 A, 273/139

[56] References Cited

U.S. PATENT DOCUMENTS

| | | | |
|---|---|---|---|
| 4,365,810 | 12/1982 | Richardson | 273/269 |
| 4,378,940 | 4/1983 | Gluz et al. | 273/269 |
| 4,455,025 | 6/1984 | Itkis | 273/269 |
| 4,475,157 | 10/1984 | Bolan | 273/269 |
| 4,624,462 | 11/1986 | Itkis | 273/269 |
| 4,651,995 | 3/1987 | Henkel | 273/237 |

*Primary Examiner*—Leo P. Picard

*Attorney, Agent, or Firm*—Fitch, Even, Tabin & Flannery

[57] ABSTRACT

A gaming board for matching symbols which are selected at random with symbols stored in the board to form a selected pattern, particularly where the symbols are numbers and the pattern is a plurality of elements of a 5×5 array. The gaming board when used for a BINGO game receives a schedule of a gaming session permitting a plurality of independent games, each with a number of win levels and payout places. A load mode is used to randomly input numbers for selectable BINGO cards which are then played during the independent games in a play mode. A set time for loading the BINGO cards into the gaming board is maintained by a counter which, when expired, automatically loads random numbers into those cards which have not been filled. A three tier power conservation and security operation is used to control the power supplies of the gaming board. Initially, the gaming board can only be powered on by connection to a system base station and turns itself off upon command from the system base station. During operation, an elapse of a predetermined interval without a key activation will power down the display and an elapse of a longer interval without a key actuation will power down the gaming board requiring reconnection to the base station.

23 Claims, 14 Drawing Sheets

ELECTRONICS GAMING BOARD FOR BINGO

The invention pertains generally to electronic gaming boards and is more particularly directed to an electronic gaming board which provides means to automatically execute a predetermined gaming schedule and further provides means for playing special games from internally generated random numbers.

In BINGO and similar games of chance the basic elements of the game are a gaming board and a random number generating device. The gaming board can be a square array of numbers, usually a 5×5 array, with the centermost location being blank or termed a "free space". The game is played generally with either 75 or 90 numbers with each column in the array limited to only one-fifth of the numbers e.g., the first column numbers are taken from the group 1 to 15 in the event 75 numbers are being selected from, 1 to 18 if it is 90; the second column numbers are taken from the group 16 to 30 or 19 to 36, and so on. Further, duplicate numbers connot appear on the gaming board.

When the game is being played, the game operator specifies a shape or pattern to be formed on the gaming board by randomly drawn numbers and then proceeds to call numbers at random between 1 and 75 or 90, whichever is appropriate. If a number called coincides with one on a player's board, the player marks the number in some fashion on his board. The object of the game is to be the first player to have a set of randomly called numbers coincide with the marked numbers on the player's board so as to form a specified shape or pattern.

The specified shape or pattern may be an X, T, L, a diagonal line, any five numbers horizontally or vertically, and so on. Several of these games, usually between twelve and eighteen, constitute a BINGO program or session which is played during the course of an evening over several hours. The games are played consecutively and essentially without any major interruption except for possible intermissions.

These games have long been played with boards which have a fixed printed numerical array. Players select from a large number of boards and, therefore, are unable to create and play with an array of their own choosing and determination. While some games have been played with blank paper boards that are filled in by the player writing in the numbers of the array desired, the cards are limited in size and can essentially only be used once since the player marks out the numbers called with an ink dauber or like means. This type of random array selection results in an inefficiency of operation for playing consecutive games on a minimum interruption basis.

This inefficiency affects not only the game operator, who must find and check a copy of the marked paper boards which are collected to avoid an unauthorized change in the numbers once the game has started, but also the player, who must prepare a new board prior to each game. These actions require time and detract from the desired even, and essentially uninterrupted, flow of a successful BINGO program. It is mainly for these reasons that the blank board approach has been used only for single games and then generally only the first game of the BINGO program.

Another important factor is to provide a gaming board which cannot be changed without the knowledge of the game operator, which provides an indication that it was acquired for use in the particular program being conducted, and which can be checked quickly in the event it displays a winning combination. Further, because generally each game during a normal BINGO program varies as far as the shape which the winning array may take, it is desireable for the player to have the shape of a winning array promptly displayed on his board and, further, to be provided with an automatic indication of when a match for that array has been achieved.

Recently, electronic gaming boards have been developed to provide the advantage of a board where a player can easily select his own numbers, one which displays the shape of the array to be formed from the randomly called numbers, and further signals the player when a winning array has been achieved on his board. An electronic gaming board of this type is more fully described in U.S. Pat. No. 4,365,810 issued in the name of John Richardson on Dec. 28, 1982. Another advantageous electronic gaming board is disclosed in copending application U.S. Ser. No. 820,521; entitled "Multiple Gaming Board" filed in the name of John Richardson. The disclosures of Richardson are hereby expressly incorporated by reference herein.

Even with this improvement in game play with electronic gaming boards, the play during a BINGO gaming session has become much more complex. More and different types of games are played today than just the five across, up or down of the natural BINGO. Specialized win patterns for each game are becoming standard and the multiplicity of patterns is becoming difficult to provide for on the gaming boards as individual select switches because of their proliferating number. Further, the gaming schedules are complicated by playing either regular cards or special cards for a particular game. It is necessary for a player to recognize and determine which type of card and game is being played for a particular gaming schedule.

Moreover, even in a single game there may be multiple win patterns or levels that build to a final payoff. For example, the final win pattern may be three completely filled horizontal bars comprising the first, third, and fifth rows of a card. A first level win pattern may be the fifth row, the second level win pattern may be the fifth and first rows, and the third level win pattern or final payoff given to the first player to totally fill in the three bars. It is difficult with presently configured electronic gaming cards to play different game levels conveniently. These complex schedules become even more difficult to play when considering that many players will have multiple cards or boards to play.

Moreover, many BINGO gaming sessions today offer place payouts where there is a declining amount for a sequence of wins. The first person to obtain a particular pattern receives a substantial first prize, a lesser amount is awarded the second person to obtain the same pattern, and a lesser amount is paid to the third person to obtain the same pattern, and so on. These place type games are also somewhat more difficult to play on the presently configured electronic gaming boards.

One of the more popular past times during intermission at a BINGO gaming session is now "instant" or "break open" BINGO. While this game can be played in a variety of different ways and on different types of cards, the principle of the game is essentially the same. The players purchase cards where all the numbers are covered by pull tabs and no caller is involved. The player simply peels off or breaks open the tab and if the card contains B, I, N, G, O in any order or rotation, it is scored as a win. Because the electronic gaming boards configured today cannot be used to play this game, an operator is required to use two different types of cards and to employ more people to sell these instant cards.

For security reasons, the above-referenced electronic gaming boards of Richardson use a timer which, after a predetermined amount of time has elapsed, locks out the board from play if the purchased card(s) have not been filled. While accomplishing its security purpose, this operation for an electronic gaming card causes the gaming session to be somewhat more inflexible than is necessary. For example, if every gaming card is set for a predetermined time, then no gaming cards can be sold within that interval before starting the game or the session cannot begin on time. Further, these predetermined time periods, if fixed for all the cards, make it difficult to buy cards between games of a gaming session or at intermission. Moreover, there are players who do not want to choose their own numbers and consider it an imposition to have to fill out a gaming card on an electronic board. Further, an operator must make some provision for those players who have already paid for cards, but because their time has elapsed for filling the card do not get to play in a particular game or gaming session.

Another problem which confronts the operator when using electronic gaming cards, or even regular paper cards, is the lack of available auditing procedures. Because a winning player is paid in cash at the time of his win if some inconsistency developes either in the amount paid or one game where the total amount paid over all the games, there is no practical means for correcting the error.

Because electronic gaming cards today are hand held, battery powered apparatus, a considerable maintenance cost for such cards is changing the batteries. Generally, such hand held, battery powered devices have a on/off switch which connects and disconnects a battery from the circuitry such that power can be conserved during non-use. However, in a gaming session context, an operator does not want a player to be able to turn on and off an electronic gaming card for a number of reasons.

Initially, if the electronic gaming board stores information in a random access memory, turning off the card during the gaming session will excise this information from memory. Secondly, for security purposes as much as for power savings, the gaming operator does not want an electronic gaming board operable until the start of the gaming session and then would prefer it to be disabled after the gaming session is complete. This type of operation would prevent unauthorized use and persons from storing or reading data from the electronic gaming board to affect play of the game.

SUMMARY OF THE INVENTION

The invention solves these and other problems for a BINGO gaming session, or the like, by providing an electronic gaming board which can be used by a player to automatically execute a complex gaming schedule, which can be used to play instant BINGO or similar games, which store audit records of wins, which will randomly load stored BINGO cards on command or at the expiration of a loading interval which can be varied from gaming board to gaming board, and which can control its display and main power supplies to conserve energy and for security purposes.

The electronic gaming board comprises a microprocessor based apparatus which includes means for communicating information between the board and external devices, means for storing information, means for executing a load mode of operation for entering arbitrarily selected numbers or symbols into a number of predetermined arrays; and means for executing a play mode of operations for operating on said arrays according to a predetermined set of game rules with randomly selected number or symbols. Preferably, the set of game rules defines the game of BINGO, or the like, where randomly called or generated symbols are matched against a selected array of symbols and the object of the game is to form a predetermined pattern of matches first.

One aspect of the invention utilizes the communication means of the gaming board to store a gaming schedule which can be executed during the play mode. The schedule indicates the number of games for a gaming session and further describes the pattern of the win for each game. The win pattern is further divisible into several win levels where partial patterns of a larger pattern can be used for sequential wins during a game. The gaming schedule can additionally accomodate a win pattern which is repeated during a game such that place awards can be made.

The storage of a complex gaming schedule by the gaming board and its automatic execution facilitates game play and reduces player error. The player can participate in the gaming session with a larger number of cards which increases his chances of winning, without having to keep track of the level, place, and win pattern for each game and whether the game requires a regular or special card. Further, the win pattern selector switches of present electronic gaming boards can be eliminated as different patterns are capable of being stored within the gaming board. Completely arbitrary win patterns can be chosen for each game, level, place for a session because the gaming board can play any pattern communicated with the gaming schedule. This feature permits a game operator complete flexibility in chosing the win patterns and permits the changing of patterns from session to session.

Another aspect of the invention utilizes the communications means for storing a variable time interval in which to load the arrays. After the time interval has expired, a random selection means completes any unfilled cards with random numbers and then transfers of the gaming board to the play mode. This feature provides a number of distinct advantages. A player who has made an error, has forgotten to fill in an array, or does not want to chose numbers, is not excluded from game play. The gaming card automatically switches to a play mode at a predetermined time with all the arrays filled, either by random number selection or by selection from the player.

Further, the provision for entering a variable loading interval into the gaming card increases flexibility in the gaming session. Persons purchasing cards 20 minutes before the start of the session have 20 minutes to load their cards, persons purchasing cards 10 minutes before a session have 10 minutes, etc. Moreover, during intermissions which are variable in length, more cards can be purchased and loaded while still ensuring that the next game will start on time and all boards will be ready for play at the same time.

Another aspect of the invention uses the random selection means to provide a play mode similar to instant BINGO. Upon the selection by the player of an instant BINGO operation, the gaming card will display one of the stored arrays. The player uses the input means to request a chance and the gaming board randomly selects one symbol of the array and blanks it. The player has an operator settable number of chances for array symbol selection in which a particular pattern of blanks must be formed to win. In the preferred embodiment the winning pattern is a regular BINGO pattern of five symbols in a row—horizontally or vertically.

Still another aspect of the invention provides an auditing feature where a record of a win, either for a regular or instant BINGO, can be validated by an independent validation apparatus and a record of information of that win transferred to the validation apparatus.

A still further feature of the invention provides a three tier power conservation and security operation for control of the power supplies of the gaming board. Initially, the main power supply of the gaming board can only be turned on by connection through the communications means to an external apparatus which can also provide a command to turn the gaming board off. During operation, an elapse of a predetermined period without a key input activation will power down the display and an elapse of a longer predetermined period without a key input activation will completely power down the gaming board requiring a reconnection to the external apparatus for a restart.

These and other objects, features, and aspects of the invention will become apparent upon reading the following detailed description when taken in conjunction with the attached drawings wherein:

DETAILED DESCRIPTION OF THE PREFERRED EMBODIMENTS

Figure 1:
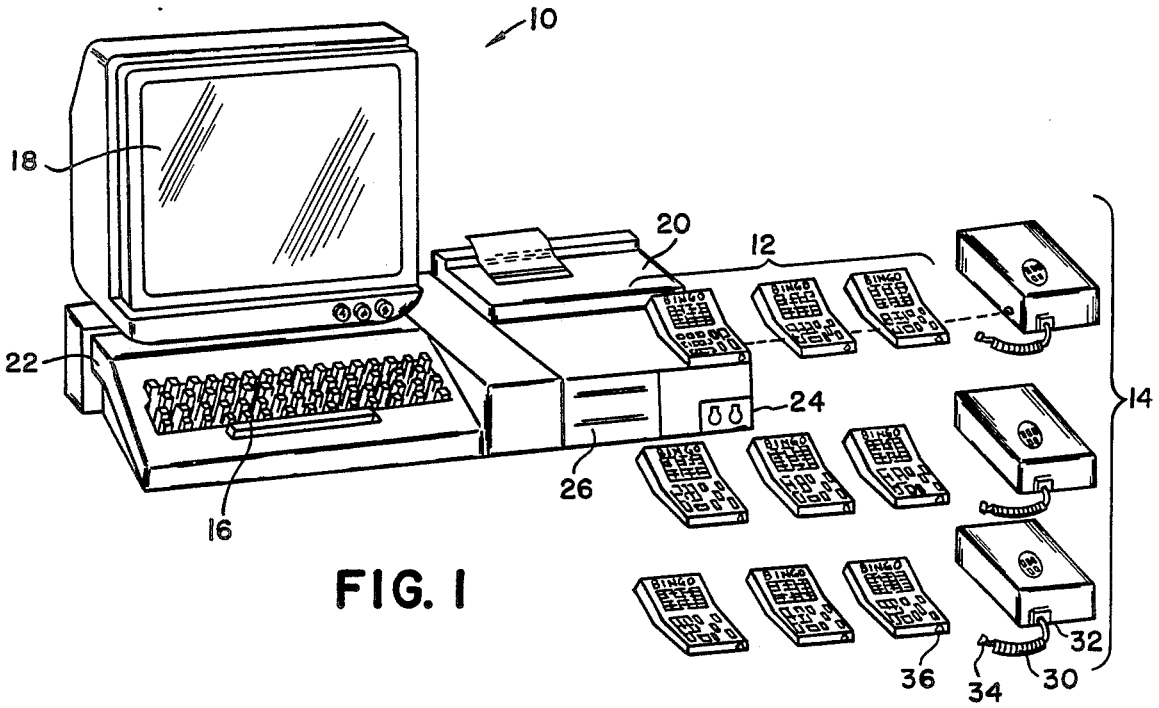
FIG. 1 is a pictorial representation of an electronic gaming system including a electronic gaming board which is constructed in accordance with the invention.

In FIG. 1 there is shown an electronic BINGO system including an electronic gaming card constructed in accordance with the invention. The electronic BINGO system comprises three major components including a system base station 10, a plurality of electronic BINGO or gaming boards 12, and a plurality of validation units 14. The system base station 10 includes a keyboard 16, video monitor 18, printer 20, computer 22, communications cradle 24, and disk drive 26 connected as a data processing system.

The system base station 10 is microprocessor controlled and functions as a point of sale terminal and accounting or auditing center. The system base station 10 uses the communications cradle unit 24 to connect any of the electronic gaming boards 12 or any of the validation units 14 such that data can be transferred between the devices. The electronic gaming boards 12 are used by players in place of physical paper cards and markers which traditionally have been used in the game of BINGO.

In general, each electronic gaming card 12 is in turn connected through cradle 24 to the system base station 10 during an initialization step station such that it is downloaded with a gaming schedule so that a player may use it in a series of games termed a gaming session. The electronic gaming cards are also downloaded from the system base station 10 with an assignment code, a validation code, game parameters, and optionally firmware to execute. The player loads an electronic gaming card 12 by arbitrarily selecting the symbols (numbers) which comprise each of the BINGO cards he has purchased. After loading, the gaming cards 12 enter the play mode where matching the called numbers takes place. As the numbers of a particular game are called, the player enters those numbers into the electronic gaming board 12 to determine if they match any numbers of one of the BINGO cards contained therein. A particular game in the session is played until one or more of the electronic gaming boards 12 signals, audibly and by a visual indicator, that the game has been won. A payout is made using the validation units 14 and play is resumed until an entire gaming schedule is completed.

The validation units 14 are additionally initialized by connection to the cradle 24 of the system base station 10 and receive an assignment code and the validation code for the particular gaming session. When a player scores a BINGO, or other type of winning combination, one of the validation units 14 is used to verify that the win was legitimate. At the same time information specific to a win is recorded within the validation unit 14 and later these stored data records are uploaded to the system base station 10 via the cradle 24.

Figure 2:
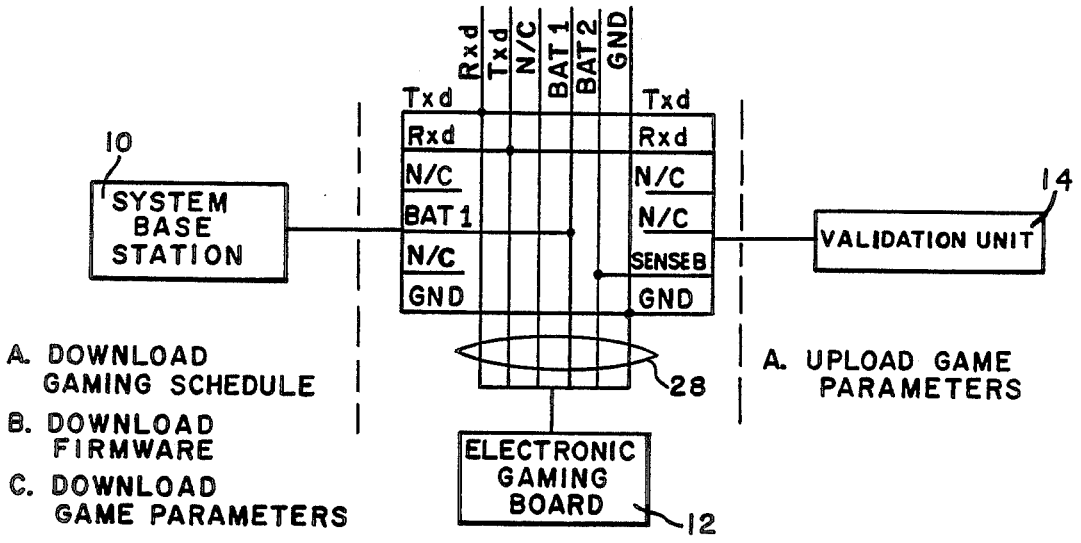
FIG. 2 is a block diagram view of the electronic gaming card illustrated in FIG. 1 showing its electrical connection to either a system based station or a validation unit of the system illustrated in FIG. 1.

As more fully detailed in FIG. 2, the gaming board 12 communicates with either the system base station 10 or a validation unit 14 through a serial digital communications interface including an adaptor plug 36 (FIG. 1). The adaptor plug 36 is a six pin female type telephone jack which is available for connection with the other devices. The validation unit 14 connects to the adaptor plug 36 through a cable 30 with a male plug end 34. The cable 30 has a male plug end 32 which connects to a similar adaptor plug of the validation unit 14. Connection to the system base station 10 is through a male plug of the cradle 24. The pins of the adaptor plug 36 form a serial data transmit line Txd, a serial data receive line Rxd, two low voltage detection lines BAT1, BAT2, a nonconnected pin NC, and ground. These pins connect to similarly labeled pins of the cradle 24 and plug ends 34 of the validation units 14.

Figure 3A:
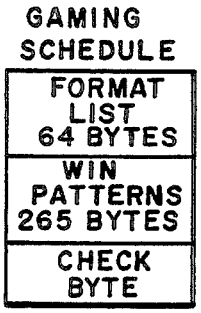
FIGS. 3A–3F are pictorial representations of the data packages which are transfered between the electronic gaming card and the system base station or the validation unit.
Figure 3B:
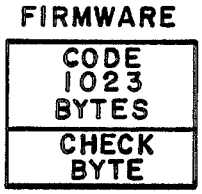
Figure 3C:
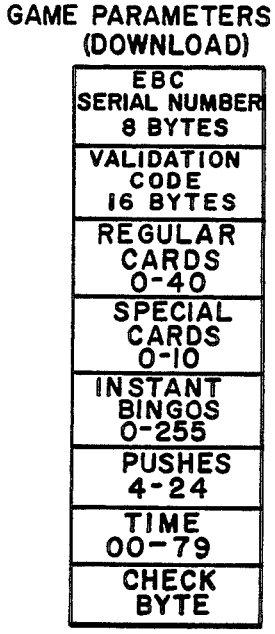

The system base station 10 can download through the communications interface three different type of data blocks as illustrated in FIGS. 3A, 3B, and 3C. A gaming schedule is shown in FIG. 3A and preferably includes 64 bytes of format list and 265 bytes of win patterns, and ends with a check byte. The second type of block which can be downloaded into the gaming card 12 is a 1023 bytes of firmware which is terminated by a check byte. The block of firmware is executable by the gaming board 12 upon a special sequence of key actuations or command. It is used for special security applications or other functions.

The last block of data which can be downloaded is the game parameters shown in FIG. 3C. The system base station 10 assigns each gaming card 12 an 8 bytes serial number defining the card and a player to which it is provided for a gaming session. The serial number is used for audit purposes to track the cards in play and is the first 8 bytes of the game parameters. The next 16 bytes of the game parameters is a validation code which is identically input to every other gaming card 12 and validation unit 14 to define a gaming session.

Next in the game parameter block is a byte indicating how many regular cards the player has purchased which can have values between 0–40. The following byte is the number of special cards, between 0–10, purchased and, thereafter, a byte indicating the number of instant BINGO games between 0–255, purchased.

The next to the last byte of information in the block indicates the number of chances available to select instant BINGO spaces. The last information byte is a number between 0–79 indicating the time in minutes that a player has to load the card before it automatically switches to play mode. This variable is to ensure that play of the game starts all cards at the same actual time.

Figure 3D:
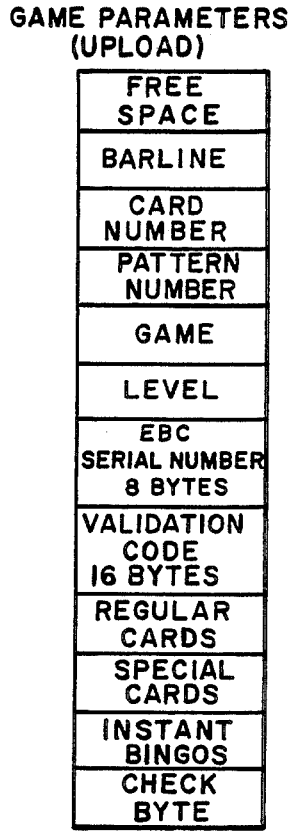

The validation unit 14 can upload through the communication interfall a block of data as illustrated in FIG. 3D. These game records or parameters are assembled internally with the gaming board and are available upon command from the validation unit 14. The first six bytes of this block are the values of status indicators for the gaming card at the time of a win or a validation command. The status (contents) of the free space, the annuciator bar, morefully described hereinafter, and the pattern, game, and level of the gaming schedule are uploaded. The next 27 bytes are copies of the initialization information downloaded previously including the serial number, validation code, and number of regular, special, and instant cards. The block ends with a check byte.

Figure 3E:
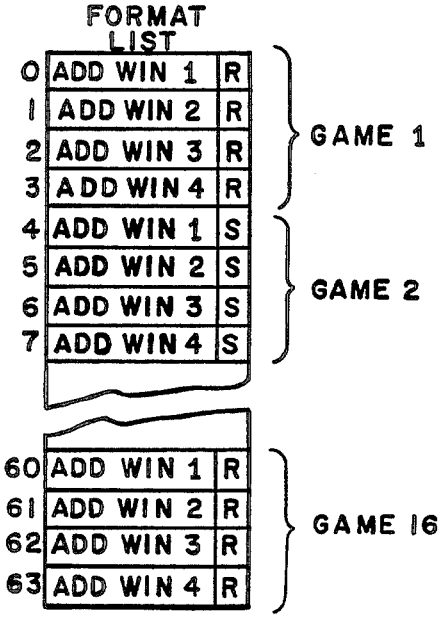
Figure 3F:
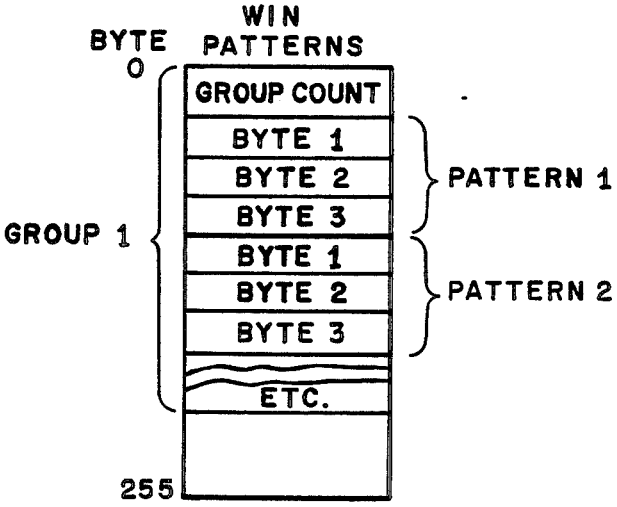

A flexible and complex gaming schedule can be formed by the system base station 10 and downloaded into each gaming board 12. FIGS. 3A, 3E, and 3F illustrate a schedule for a typical 16 game session with up to either 4 sublevels or places for each game. The schedule is separated into a format list and a plurality of win patterns. The 16 games of the session are each assigned four bytes which contain addresses of win pattern groups in the win patterns. Therefore, each game area of the format list points to the winning pattern for that particular game. For different level games the addresses of the win pattern groups can be different each building into a more complex pattern. For different place games the addresses of the win pattern groups can be repeated. In addition combinations of place and level games may be played in this manner. For example, a two level game with a first and second place for each level can be played by storing the same win group addresses for the first and second byte of a game and another win group address in the third and fourth byte. It is evident that a 16 game, 4 level place schedule is a completely arbitrary choice and other schedules of this type can be used.

Each win pattern group comprises a group count byte and a plurality of 3 byte (24 bits) win patterns. Each bit of a win pattern is assigned to one of the 24 spaces of the 5×5 BINGO array (free space is excluded) and a pattern formed by selecting which spaces must be matched for a win. The selected spaces are marked (one or zero) and the remaining bits filled with the other logic value. The group count number identifies the number of ways or win patterns that will result in a win. For example, regular BINGO has 12 win patterns (5 rows, 5 columns, 2 diagnols).

Figure 7:
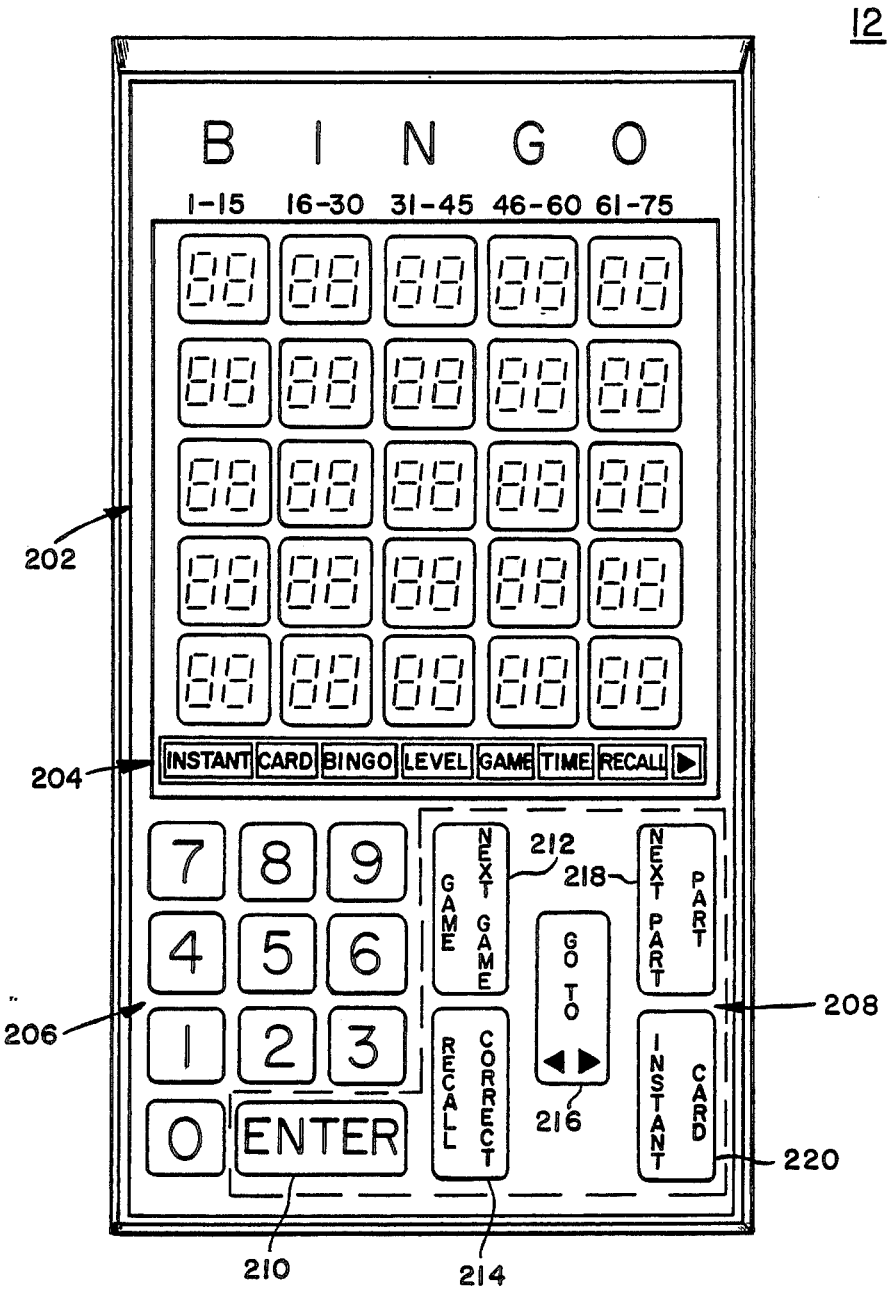
FIG. 7 is a plan view of the display and input means for the electronic gaming board illustrated in FIG. 1.

FIG. 7 depicts a plan view of the electronic gaming board or BINGO card 12. The gaming board 12 is essentially divided into four main sections. First, there is a liquid crystal display (LED) section 202 with 25 array symbol display spaces each having two 7-segment digits each. Preferably, the display is in the form of a 5×5 array of rows and columns forming a BINGO card which can be used to display the numbers of a BINGO card or other types of information. The second section 204 is an LCD annunciator bar divided into a plurality of status and mode indicators. These annunciators indicate schedule status i.e. game, card, and level numbers presently in play, and three annunciators indicate gaming board mode, i.e. instant, recall, and BINGO mode. A time annunciator indicates whether time remains to load the cards and a go to (arrow) annunciator indicates a transfer or shift to special functions.

The third section of the gaming board 12 is a decimal membrane type key pad 206 for entering digits 0–9 into the board. The fourth section 208 allows the player to operate the gaming board 12 by providing a plurality of membrane type function keys. In this particular gaming board 12, the number of function keys is six and provides a very convenient operation of the board by a player. The six function keys are the enter key 210, a game (next game) key 212, a recall (correct) key 214, a go to or shift key 216, a part (next part) key 218, and a card (instant) key 220. The parenthetical functions of the keys 212, 214, 218 and 220 are reached through the sequence of first pressing the shift key 216 and then the desired operation. Normal function is obtained for each key 212, 214, 218, 220 by direct operation.

The four sections of the gaming card including the display 202, annunciator bar 204, numeric key pad 206, and function keys 208 provide for the facile playing of a complex gaming schedule without a long familiarization process by a player. A player can easily execute or play a substantial BINGO schedule comprising up to the 16 independent games with up to four levels or four places per game. For each of the independent games, a player may play up to 40 cards automatically with ease and without any worry that a winning BINGO may not be noticed. Each game, level/place can contain an arbitrary win pattern which is automatically recognized from the stored gaming schedule.

The electronic gaming board 12 is always in one of three mutually exclusive modes. It is in a communications mode when connected by its interface adaptor 28 to either the system base station 10 or a validation unit 14, in a load mode prior to the start of a gaming section or at an intermission, and in a play mode during the gaming session. Further, the communications mode may be used to interrupt the load or play mode at any time by connection to one of the external units.

After the playing schedule has been downloaded into the gaming card 12, the player uses the numeric key pad 206 to enter arbitrary numbers to fill the array spaces of each game card he has purchased. Initially, the display 202 is blank and the player presses two numeric digits on the key pad 206 and then presses the enter key 210 to display that number in one of the squares. The squares of an array forming a card fill up in a predetermined sequence and the player can select arbitrary numbers within the range of the particular column of a card. The player is prevented from chosing a duplicate number or one out of the range of the column. After one game card is completely full, it is stored in the memory of the gaming card 12 for use during the play mode. Thereafter, the display 202 is blanked again to have the numbers of the next card arbitrarily chosen. This selection or loading process continues until all the cards which have been purchased are filled with numbers or the time for the load mode expires.

During the load mode the free space or center space displays the number of minutes remaining in the load mode and the time annunciator is displayed. If the player has not filled all of the spaces by the time the load mode expires, then a random number selection means completes the filling of the spaces for all the cards purchased and thereafter exits to the play mode. Moreover, if the player desires the gaming board to fill the cards purchased with random numbers automatically, a shift key 216 - card key 220 sequence will fill the card displayed. By repeating the sequence for all cards, random loading is easily accomplished. Therefore, upon the occurrence of the filling of all the cards purchased manually, the elapse of the load mode time, or the completion of the loading by random number generation, the gaming card will exit the load mode and begin the play mode.

Play of a BINGO game in the session is similar to the loading sequence where a player presses a two digit number from key pad 206 and then presses the enter key 210. This number randomly selected by the caller is searched for in all of the enabled game cards and marked when a match is found. On the presently displayed game card, a match causes the corresponding square or space to be blanked. If a particular win pattern for any card is completed by the match, then the gaming card will signal a win indication by displaying the BINGO annunciator and by playing an audible tune.

The function keys 212, 214, 218, and 220 are used in combination with the annunciator bar 204 and center space of the display 202 to provide game schedule information for a player. For example, by pressing the game key 212 the player will display the game annunciator and the number of the present game of the schedule in the center space as long as the key is held. Likewise, pressing the part key 218 will display the level annunciator and the number of the particular level for the present game will be displayed in the center space.

Pressing the recall key 214 will cause the display to reverse itself blanking out all numbers except those that have been marked or matched on the particular card being displayed. Those marked numbers are now displayed as they were originally while all others in the array are blank to allow a player to recall which numbers have been matched on a card. The recalled numbers are displayed along with the recall annunciator as long as the recall key 214 is depressed. In a similar manner, pressing the card key 220 causes the number of the present card to be displayed in the center space and the card annunciator to be displayed. These two indications will be displayed for as long as the card key is held.

The function keys 212, 214, 218, and 220 also have alternate functions which in combination with the shift key 216 produce specialized functions. Selecting the shift key 216 displays the arrow annunciator and cautions the player that the next function key 212, 214, 218, and 220 pressed will cause a special operation. The shift key 216 in combination with the next game key 212 causes the gaming board to move to the next game in the sequence of the gaming schedule. The sequence of the shift key 216 and the next part key 218 allows a player to move between levels or parts of an individual game. The shift key 216 selected prior to the instant key 220 allows the player to display different cards in the sequence of stored cards. The key 220 pressed during the play mode has the function of changing the cards in the display if it is pressed prior to the game mode will produce an instant game function described more fully hereinafter. Pressing the shift key in combination with the correct key 214 causes the last number entered from the key pad 206 and enter key 210 to be replaced in the stored cards instead of blanked. This sequence allows a player to reinstate a number in the stored cards in case he has made a mistake in entering the called numbers.

Figure 4A:
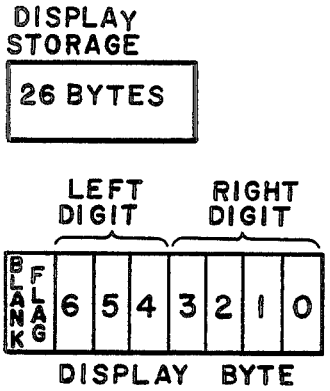
FIGS. 4A–4D are pictorial representations of storage areas used for various operations of the electronic gaming card illustrated in FIG. 1.
Figure 4B:
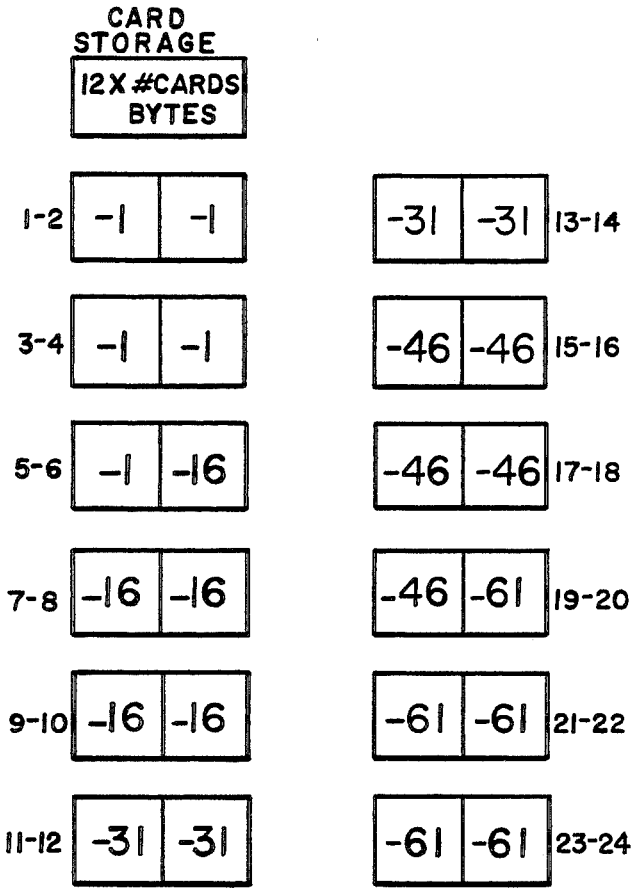
Figure 4C:
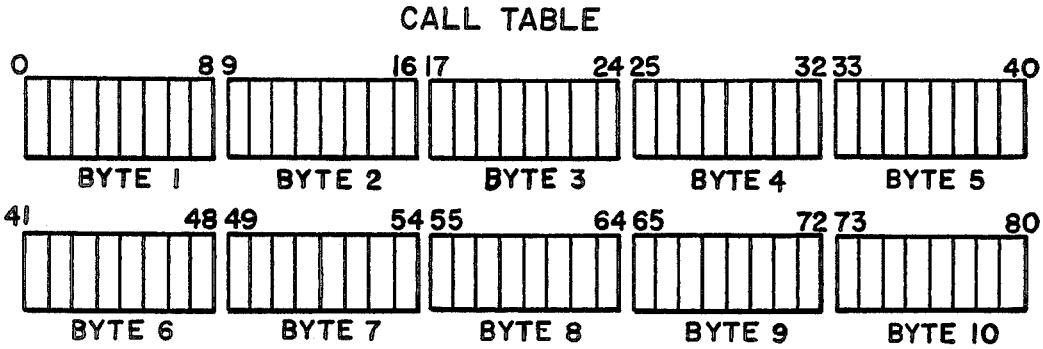

FIGS. 4A, 4B, and 4C illustrate a number of storage areas in the memory of the gaming card which assist with these functions previously described. FIG. 4A illustrates that an area of memory termed display storage contains 26 bytes. This storage area represents the 25 spaces of the display array 202 and the annunciator bar 204. Each display byte which corresponds to a space contains the two digits of that display space in the first 7 bits and a blank flag in bit 8. As matches take place the flag bits are set so that when the particular card which is stored in the display storage is shown the numbers which have been called are blanked. In contrast, when a recall function is requested, the spaces which are not flagged are blanked by the display.

Figure 12A:
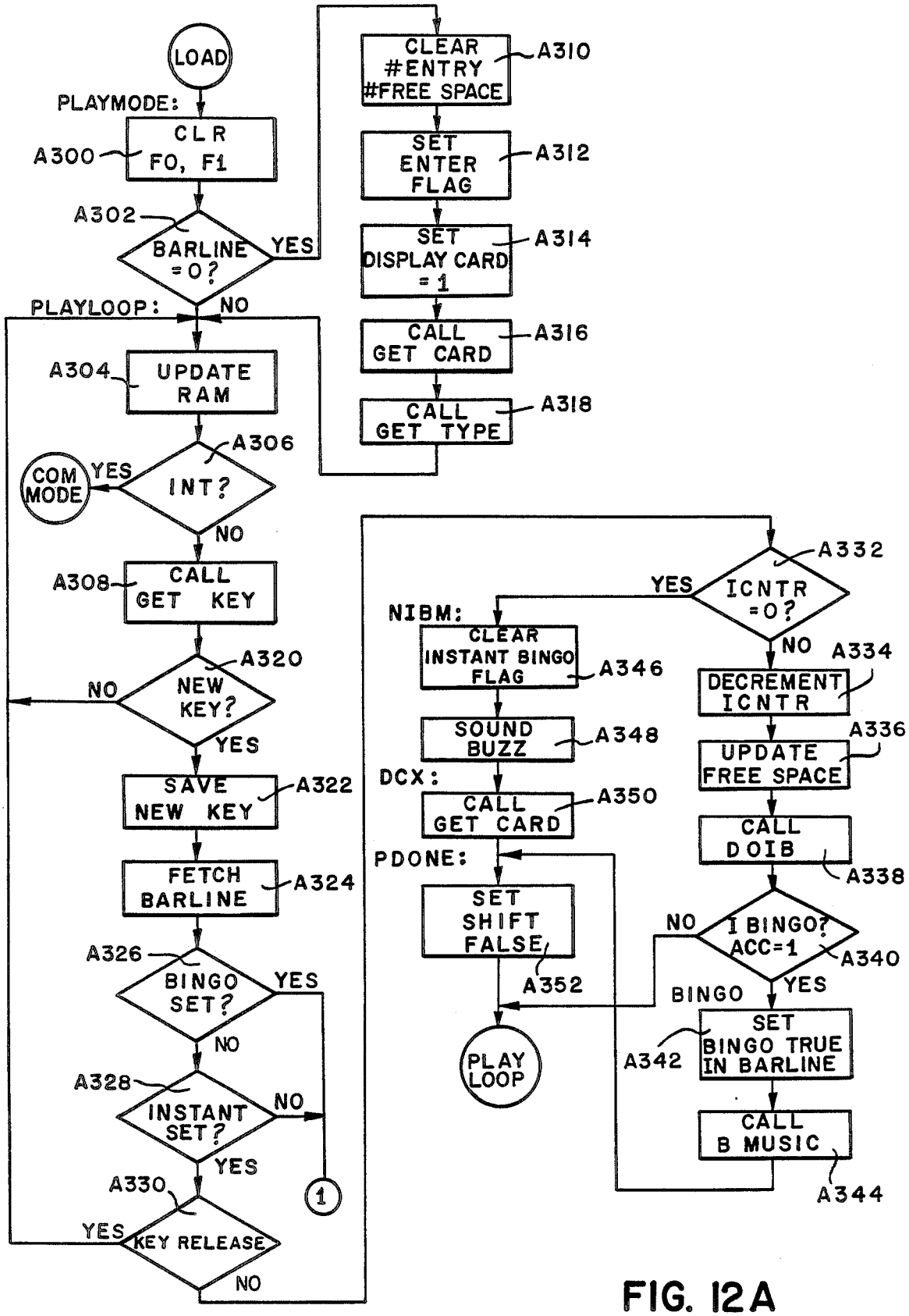
FIGS. 12A–12C are a more detailed flowchart of the play mode routine illustrated in FIG. 9.
Figure 12B:
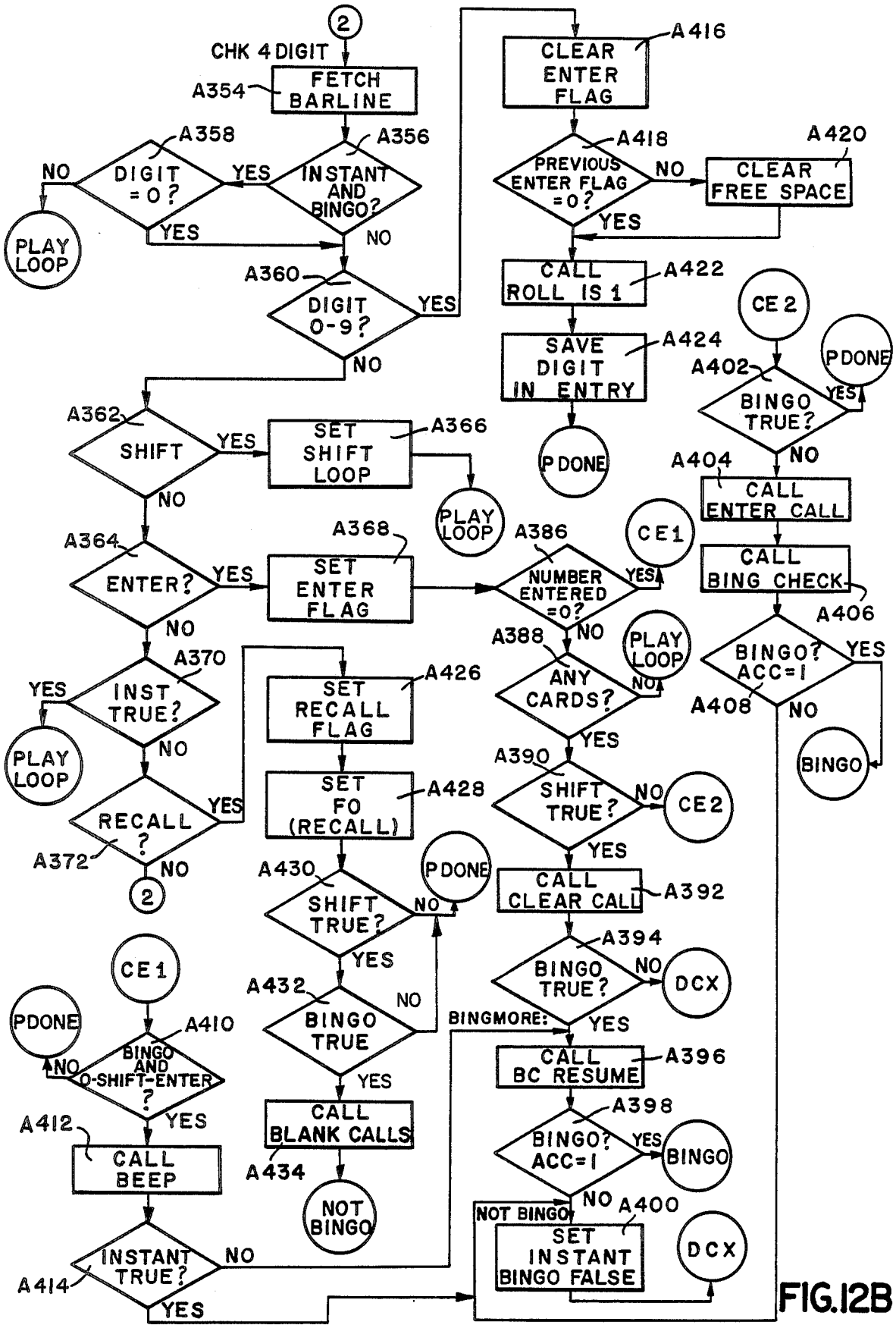
Figure 12C:
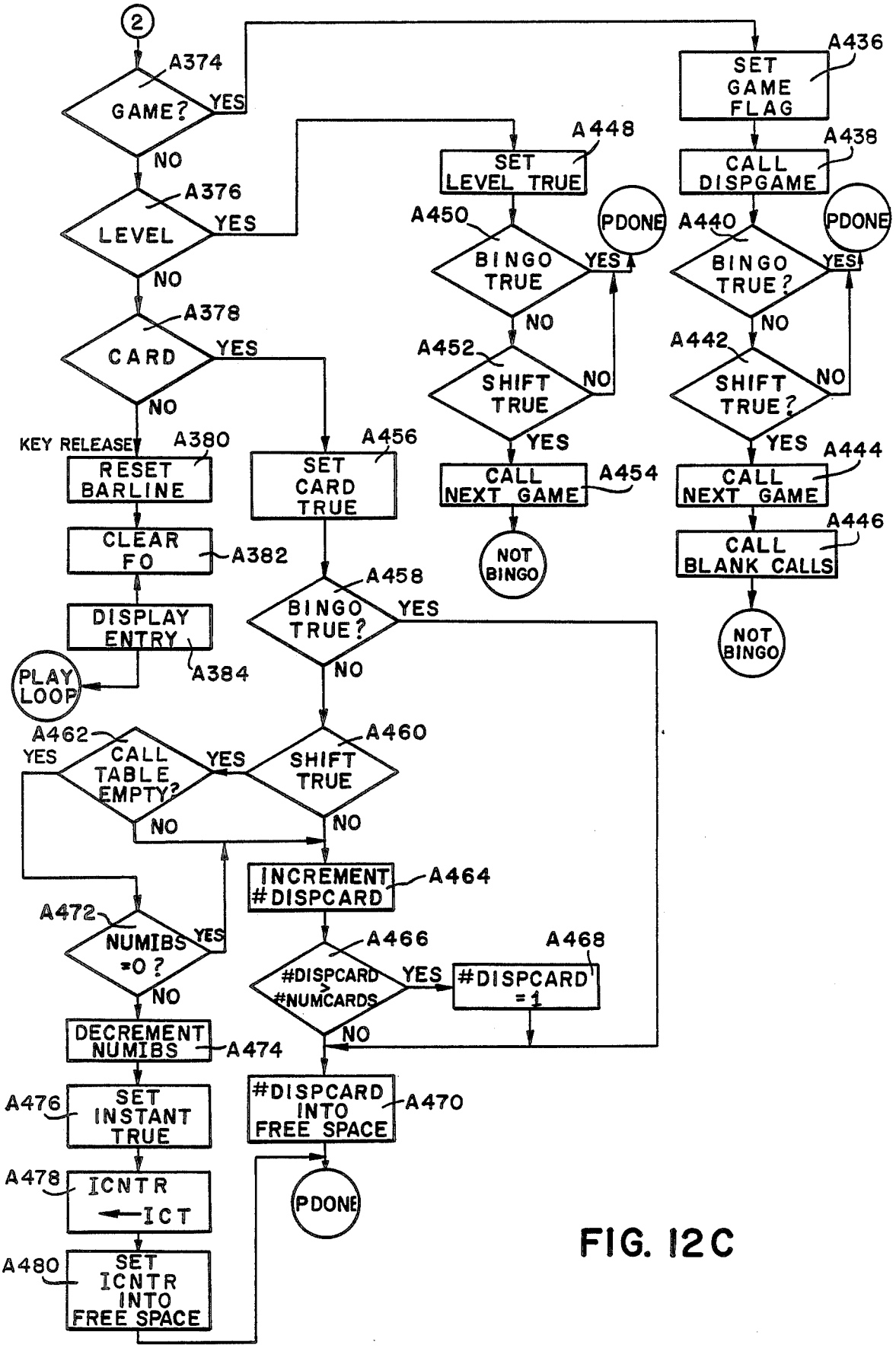

Further, there is a storage area for the total number of cards purchased termed card storage. Preferably the card storage is as illustrated in FIG. 4B and 12 bytes times the number of cards in length. Each number for a space selected in a card is stored in one nibble of a byte. An entire card of 24 numbers is stored in 12 bytes by a reduction algorithm which reduces each number to four bits in length. All numbers of a particular column of a BINGO card can have one of fifteen values. The position of the column determines an offset which can be added to the numbers 0–14 which will yield all fifteen values. The binary equivalent for 0–14 can be stored in 4 bits. Therefore, once a card is loaded in the display storage, it is reduced to twelve bytes by subtracting an offset (column dependent) from each number prior to its storage in card storage. The reverse is true when the card is to be displayed, such that a position dependent offset is added to each number when loading the display storage from the card storage. As shown in FIG. 4B the offset is 1 for the first column, 16 for the second, 31 for the third, 46 for the fourth, and 61 for the fifth.

As play progresses and the player enters numbers in the gaming board, these numbers must be remembered to determine duplicate entries, for validation, etc. The gaming board stores the called numbers in an area termed the call table which is illustrated in FIG. 4C. The numbers are stored in a plurality of sequential bytes having at least one bit for each possible number. In the illustrated example 75 bits are arranged in 10 bytes of RAM where Bit 0 in the first byte is not used, bit 1 of the first bytes represents the numeral 1, bit 2 represents the numeral 2, bit 0 in byte 2 represents the numeral 8, etc.

Figure 4D:
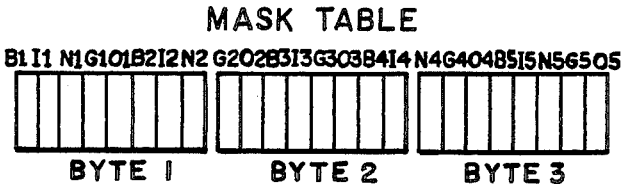

The pattern of blanked spaces on the display can be represented, as discussed previously, by 24 vits, one for each space (excluding the free space) stored in 3 bytes. A mask for each enabled card representing the numbers called is stored in an area termed the mask table as illustrated in FIG. 4D. Bit 0 of the first byte of a mask represents space B1 of a card, bit 1-space I1, bit 2-space N1, etc.

Each time a number is entered in the gaming board 12 during the play mode, the board searches all enabled cards to determine if there is a BINGO. The mask for each card is checked against all win patterns in the current format, as indicated by the schedule determining the game and level being played. If the display mask contains all the blank positions indicated by one of the win patterns, it is a potential BINGO. If, not the search proceeds to the next card until all cards have been checked against all patterns in the current format. When the search is complete, the card which was displayed when the call was entered is redisplayed and the board waits for another entry.

Figure 8:
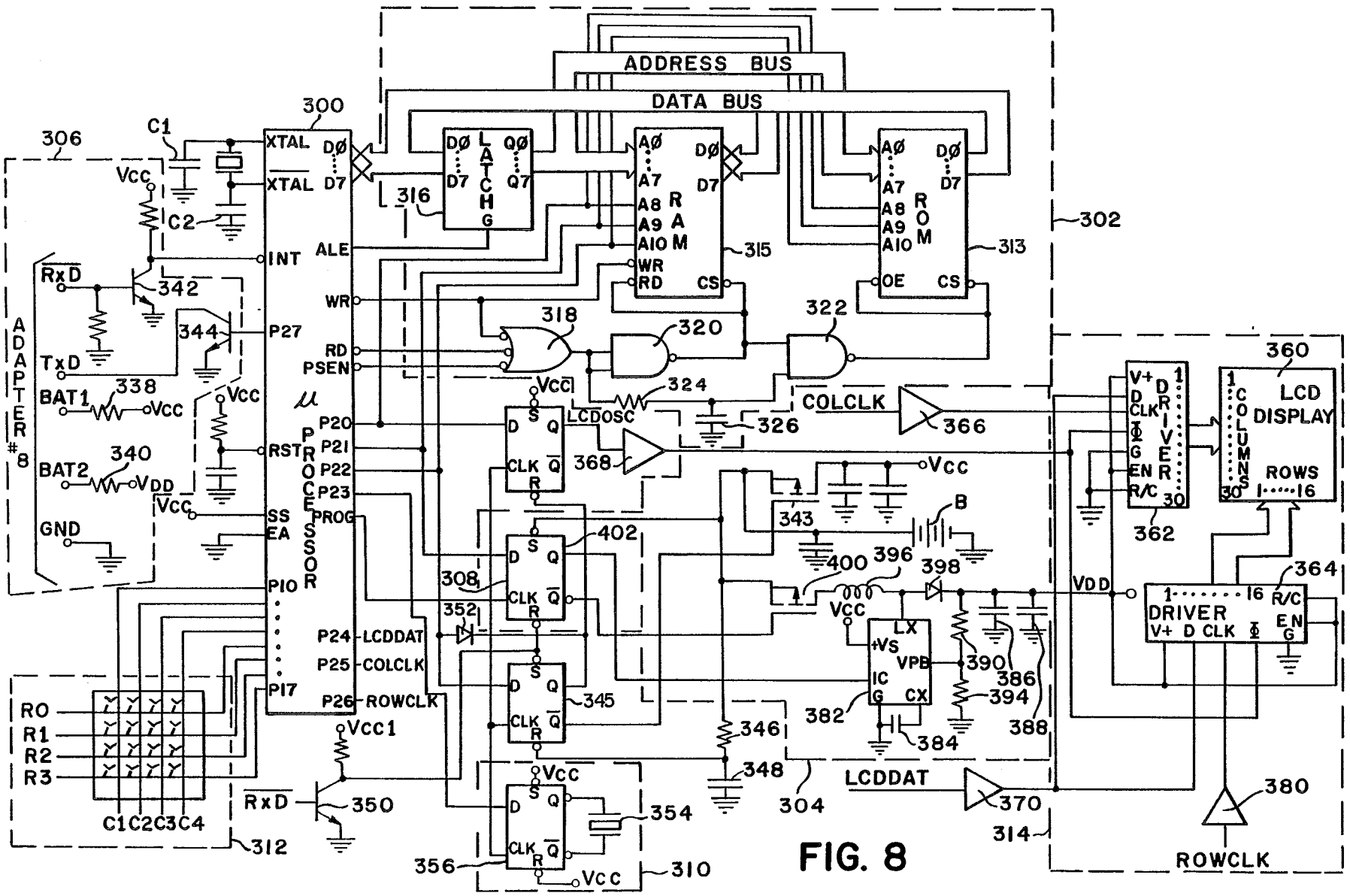
FIG. 8 is a detailed electrical schematic diagram of the circuitry comprising the electronic gaming board illustrated in FIGS. 1 and 7.

FIG. 8 illustrates a detailed electrical schematic of a gaming board 12 which generally comprises a microprocessor 300, memory and memory control 302, power supply 304, communication interface 306, power bistable 308, audio annunciator 310, key board 312, and display and display driver units 314.

The microprocessor 300 is a standard, single chip microcomputer having a data/address bus D0–D7, bidirectional input and output ports P10–P17, P20–P27, and a control bus WR, RD, PSEN, PROG. Further, the microprocessor 300 has pins for handling interrupts INT and resets RST. While the microprocessor 300 could be any type of single chip microcomputer, preferably, the device is a 80C49 microprocessor manufactured by the Intel Corporation of Santa Clara, Calif. The pin designations shown will be of that device and are more fully described in the operating manual for the Intel 80C49. A single chip microcomputer of this type includes internally a central processing unit, 128 bytes of random access memory and 16 8-bit registers R0–R15. Further, included are an 8 word by 16-bit stack and 96 bytes of general purpose RAM and, as an option, 2 kilobytes of ROM.

Communications for the microprocessor 300 with peripheral devices is carried out through the 8 bit data/address bus D0–D7, the 4 memory and I/O control lines, and the general and special purpose I/O lines. The microprocessor 300 is driven by a 6 MHz. crystal oscillator Y1 connected between its terminals XTAL and *XTAL. Each terminal of the crystal Y1 is further connected to a capacitor C1, C2 respectively whose other terminal is grounded. The external access pin EA and the single step pin SS for microprocessor 300 are not used and therefore, are tied to ground and a high logic level Vcc, respectively.

Normally, a read only memory 313 of the memory and memory control 302 will contain the control program for the microprocessor 300. Instructions are transferred from the ROM 312 via its data output pins D0–D7 which are connected to the data bus and thereafter to the data port pins Do–D7 of the microprocessor 300. The address for the ROM 313 is generated by the data port pins D0–D7 of the microprocessor 300 in addition to the port 2 pins P20–P22 for address lines A8, A9, and A10. An address byte from the data port pins D0–D7 is strobed into an address latch 316 with an alternate logic enable signal ALE. Similar connections between the data bus and the address bus for a random access memory 315 are provided by the system. At the beginning of each memory cycle, the microprocessor 300 places the low 8 bits of a memory address on the data bus and then strobes them into the latch 316 with the ALE signal. The high address bits A8–A10 have previously been set by selection of logic levels on port pins P21–P23. For the remainder of the cycle the data bus carries data from the RAM 315 or ROM 313 to the microprocessor 300 or from the microprocessor to the RAM.

Control for the direction of the data flow, and which memory that the data is taken from or written into, is controlled by the write control line WR, read control line RD, and the program sequence pin PSEN. These signals are connected with the control inputs of the random access memory 315 and the read only memory 313 via three momory control logic gates 318, 320, and 322 which have their outputs connected, respectively, to the read and chip select inputs RD, CS of the random access memory 315 and to the output enable and chip select inputs OE, CS of the ROM 313. The write control line WR of the microprocessor 300 is also directly connected to the write input WR of the random access memory 315.

When the microprocessor 300 initiates a fetch of instructions of data from an external memory, it prepares the address bus, as described above, and pulls the signals PSEN, RD, or WR, load depending upon whether a read or write opration is to take place. Gate 318 acting as a negative true, three input NOR gate produces a high logic level when any of these three signals are low. The output of this gate indicates that one of the external memory devices is being accessed. The NAND gate 320 produces a low level logic signal to select a read from the random access memory 315 if the output signal from gate 318 is a high logic level.

The NAND gate 322 generates a low logic level to select a read of the read only memory 312 when the output of gate 318 and the output of the RAM select gate 320 are both high logic levels indicating that external memory is being accessed but not RAM. A resistor 324 and a capacitor 326 form a RC delay to prevent a race condition on the read only memory select pins during the brief interval, that pin P23 and the output of gate 318 are high, but the RAM select signal from gate 320 has not yet made a transition to a low logic level due to propagation delay.

The gaming board 12 communicates with two devices external to itself, namely the system base station 10 and the validation unit 14 through communications interface 306. The communication interface 306 is designed to consume an absolute minimum of power, specially when idle, and be reasonably fast. The communication interface 306 uses an asynchronous communications protocol with the addition of a special handshaking routine to establish communications. The general communications protocol is byte serial communications with one start bit, eight data bits (no parity), and one stop bit at a data rate of 4800 baud. Serial data is transmitted via the transmit line TxD and received via the receive line RxD.

When the gaming card 12 is connected to either the system base station 10 or the validation unit 14 it acts as a slave unit and waits for the other device to initiate the communication. The gaming board 12 uses the BAT1 signal generated through resistors 338 to signal the validation unit 14 of a connection with a high logic level. The gaming board 12 uses the BAT1 and BAT2 signals generated through resistors 338 and 340 respectively to test for low battery voltage with the system base station 10.

When the validation unit 14 or system base station 10 detects the high logic level, it will establish a communications link with the gaming card 12. The link is accomplished by the master device beginning the communications by placing a zero (break) on the RxD line of the gaming card 12 (at 500, or 514). This produces an interrupt to the microprocessor 300 by causing transistor 342 to conduct. The gaming card 12 will then reply with a low level response at 502 or 504 by grounding the TxD line through transistor 344 by applying a high logic level to its base through pin P27. The master unit will again respond by setting the RxD output high at 504 or 520 removing the interrupt from the INT pin of the microprocessor 300. Thereafter, the microprocessor 300 will again reply at 506 or 517 by bringing the TxD line to a high logic level by turning off transistor 344 with pin P27. Once the handshake has been accomplished the link is established and data communications may take place.

Figure 5:
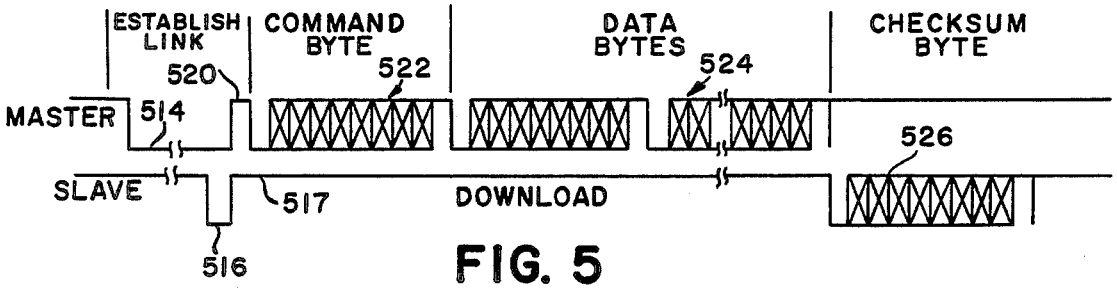
FIG. 5 is a pictorial representation of the waveforms for serial data communications downloading information into the electronic gaming card illustrated in FIGS. 1 and 7.
Figure 6:
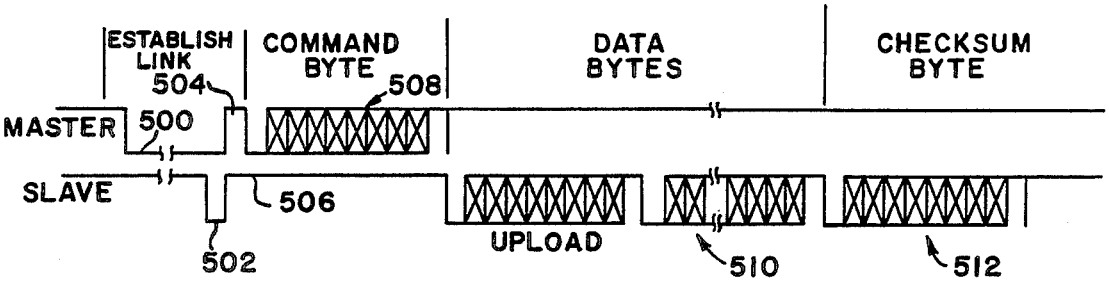
FIG. 6 is a pictorial representation of the waveforms for serial data communications uploading information from the electronic gaming card illustrated in FIGS. 1 and 7.

The system base station 10 or the validation unit 14 will then transmit a one byte command 522, 508, respectively to the gaming board 12 requesting a particular operation. Depending upon which device it is communicating with, the gaming board 12 will perform either a download operation as illustrated in FIG. 5 or an upload operation as illustrated in FIG. 6 will be performed.

The command byte is an ASCII numeral from the set 1, 2, 3, 4, and 5 (all other numbers are ignored) specifying one of five commands as follows:

"1" Download gaming schedule
"2" Download game parameters
"3" Download firmware
"4" Upload game parameters
"5" Power down After receiving the command byte, the gaming board 12 executes one of the five commanded operations depending upon the value of the byte. If the command byte is a "1", "2", or "3" the gaming board 12 prepares to receive (download) a block of data from the system base station 10. The downloaded data blocks have been illustrated previously with respect to FIGS. 3A, 3B, and 3C. If the command byte is a "4", the gaming board 12 will transmit (upload) a block of data to the validation unit 14. The uploaded data block has been previously illustrats with respect to FIG. 3D. If the command byte is a "5", the gaming board 12 will power down and turn itself off. Any other command byte value is ignored. After these actions are completed, the gaming board breaks the communication link thereby requiring the link to be re-established for further communication to occur.

Following the data block transfers regardless of whether data went to or from the gaming board 12, a checksum byte is transmitted back to the master unit. The checksum is the arithmatic sum of all the bytes transmitted after the command byte in module 256. For data transmitted from the gaming board 12, the validation unit 14 must match this checksum to the one it calculates while receiving the data. If they match, the transfer was good and if not, the validation unit 14 is responsible to re-establish the link and reissue the upload command until a good transfer is achieved. For data transmitted to the gaming card 12, the checksum must equal zero for a good data transfer as a check byte will be included in each block of data to make the check sum equal to zero if the transfer is valid. Again, if the checksum transmitted to the system base station 10 is not zero, then it is incumbent upon the base station to re-establish the link and reissue the communications until a good transfer is achieved.

The power supply circuitry 304 and the power supply bistable 308 will now be more fully described with respect to FIG. 8. The gaming card 12 has no on/off switch per se. The gaming card 12 is turned off under program control and is turned on by the system base station 10 during initial communications. The main power switch for the gaming card 12 is a P-channel MOSFET 343 connected between the battery B and voltage terminal Vcc. When the gate of the MOSFET 343 has a low logic level applied to it, the device provides a low impendance path from the battery B to terminal Vcc. When the gate has a high logic level applied to it, the MOSFET turns off thereby shutting down most of the circuitry of the gaming card 12 and conserving battery power.

The gate of the MOSFET 343 is controlled by the output *Q of a power bistable 345. The bistable 345 is powered by the battery B directly and, therefore, operates whether the MOSFET 343 is on or off. When battery power is first applied to the circuit by connecting the battery B, an RC network 346 and 348 applies a reset to the bistable 345 and clears the device. This turns the MOSFET 343 off and insures that the rest of the gaming card is off. When the gaming card is connected to the system base station 10 and current is sourced into pin 1 Rxd of the communications connector, transistor 350 turns on and applies a set signal to the bistable 345. This operation turns the MOSFET 343 on and with it the gaming board circuitry. When the program controlling microprocessor 300 decides to power down the gaming board 12, it simply writes a zero into the power control bistable 345 through pin P22. The Q output of the power control bistable 345 is further connected by a diode 352 to its D input. This is to insure that the bistable 345 will not inadvertently become set during the period when the power supply voltage to the microprocessor 300 is falling.

The gaming board 12 uses an audio annunciator to congratulate a player for scoring a win pattern. Further, audio annunciations are used to report a loss at instant BINGO and provide feedback for keypresses, etc. The device used to generate sonic energy for these annunciations is a piezoelectric bender 354. The bender 354 is a high efficiency, high impendance, low power audio transducer which can be driven by two alternating logic levels. In the illustrated embodiment, it is driven by the complementary outputs of a D type bistable 356. In this manner, the bender element 354 sees a signal with a magnitude of approximately twice the power supply voltage Vcc or about 10 Vac. Because the driving signal is a square wave, a tone from the bender element 354 is rich in harmonics and quite distinctive. The microprocessor 300 under program control toggles the bistable 356 at various frequency rates to produce different desired tones.

The display 314 comprises a display chip 360 and a column driver chip 362 and a row driver chip 364. The display chip 360 is a large liquid crystal display (LCD) whose output is shown in FIG. 8 and having a multiplexed sixteen row by sixteen column matrix. Of the resulting 480 logical display elements, only 358 are actually used. They are arranged in an array of five rows each having five positions where there are two digits in each position for a total of 50 digits. Each digit is in turn composed of seven segments for a total of 350 segments. The annunciator bar has eight separate segments for annunciator flags. The display elements are normally clear but turn dark when excited by a voltage of sufficient magnitude.

The LCD driver chips 362 and 364 require four signals from the microprocessor 300. The first is a master timing signal LCDOSC for the LCD drivers. The LDCOSC is generated as the output of pin P20 of the microprocessor 300 after division by a type bistable 367. A signal LCDDAT carries data bits which are shifted into the drivers indicating which of the elements are to be displayed and is connected to the D inputs both driver chips 362 and 364. The LCDDAT signal is generated from pin P24 of the microprocessor 300. A signal ROWCLK clocks the data bits into the row driver 364 on its falling edge and a signal COLCLK clocks the data into the column driver 362 on its falling edge. The signals ROWCLK and COLCLK are generated from pins P26, P25, respectively of the microprocessor 300. Because the LCD drivers 362, 364 operate off of a power supply that is about 10 V, it is necessary to shift these four logic signals from the microprocessor 300 up to a higher voltage level. This is done through voltage level shifters 366, 368, 370, and 380.

The LCD driver chips 362 and 364 and shifters 366–370, and 380 require a voltage supply Vdd of about 10 V. The gaming board 12 generally is powered by battery B having about 4.5 V at most and as low as 3.5 V when nearing depletion. The 10 V for the driver chips 362 and 364 is generated by a step-up voltage regulator 382. An external capacitor 384 on input CX serves as a timing element for an oscillator internal to the regulator 382. By pumping current into and out of the capacitor 384, a triangular waveform is produced with a 50% duty cycle. The output voltage of the regulator 382 across capacitors 386 and 388 is divided down by resistors 390 and 394 and fed back to input VPB where it is compared against an internally generated reference of 1.3 V. If the feedback voltage is less than the reference, then the output LX of regulator 382 is turned on for one-half cycle of the oscillator thereby shorting that point to ground.

While the output LX is grounded, current ramps up through an inductor 396 causing energy to be stored in its magnetic field. When the oscillator switches to the other half cycle, the output LX shuts off and no longer sinks current. However, current continues to flow through the inductor 396 causing the voltage at rectifier 398 to increase until it becomes forward biased. Current flows through the rectifier 398 charging the output filter capacitors 386 and 388 until the energy stored in inductor 396 is expended. The output voltage of the regulator 382 is controlled to 1.3 V* (R390+R394)/R394 which is designed to be about 10 V.

The regulator 382 can also be turned off by control of current to input pin 1C. When current is removed from pin 1C the regulator 382 shuts down drawing almost no current. This prevents it from stepping up the battery voltage, although a path still exists for current to flow from the battery B through inductor 396 and rectifier 398 to Vdd. To prevent this when the display power supply is to be shut off, a MOSFET 400 is disposed between the battery B and inductor 396. When the gate of the MOSFET 400 is at a low logic level, the device is on and provides a low impedance path for battery current to the regulator circuit. When the gate of the MOSFET 400 is at a high logic level, the device shuts off preventing current from flowing through to the inductor 396 and the rectifier 398. A bistable 402 is used to turn the step-up regulator 382 on and off. The 1C input is connected to the Q output of the bistable and the gate of MOSFET 400 is connected to the *Q output of the bistable 402. The bistable 402 is set or reset by program control via the output pin P21 and the clock signal PROG. The bistable 402 is reset upon power on and whenever the gaming card 12 enters a power conservation mode.

The gaming board 12 has the sixteen membrane keyboard 312 by which the player inputs numbers and functional commands. The sixteen keys of the keyboard correspond to the digits 0–9 and the six function keys described previously. The keyboard is a four row by four column key switch matrix which shorts one row to one column when a single key is pressed. The rows and columns of the keyboard 312 are connected to port 1 pins P10–P17. The pins P10–P13 are columns and the pins P14–P17 are rows. To scan the keyboard for a keypress, the row pins are pulled to a low logic level through pins P14–P17, one at a time and the column pins P10–P13, normally high, are checked by the microprocessor 300 for a low logic level. If only one row pin going low produces only one column pin low, then exactly one key has been pressed and that key is the one detected. Key debounce and edge detection is accomplished by the control program.

Figure 9:
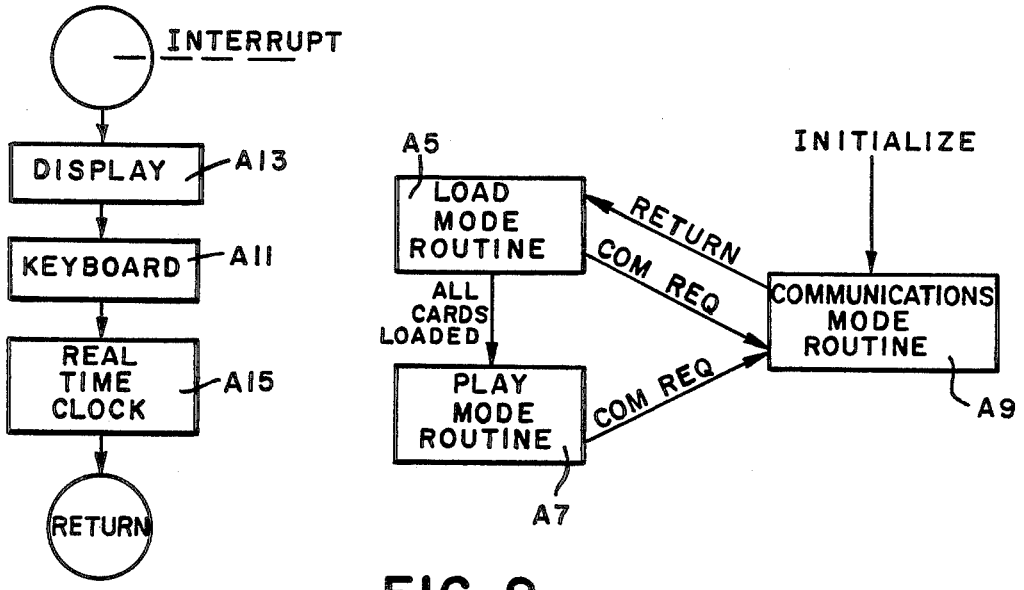
FIG. 9 is a system flow chart of the control program which regulates the processes and signals of the microprocessor illustrated in FIG. 7.

FIG. 9 is a system flowchart of the programming for the control program stored in the gaming board 12 which operates to regulate the system. There are three main software portions of the control program including a load mode routine illustrated as block A5, a play mode routine illustrated as block A7, and a communications mode routine illustrated as block A9. When the gaming board 12 is originally powered up by connection to the system base station 10 there is a initialization routine which is executed as part of the communications mode routine in block A9. If the gaming board is not successfully programmed with a schedule of play and game parameters (how many cards, etc.) it will be powered down. Once it is successfully programmed, the gaming board 12 will enter the load mode routine in block A5 where the player is allowed to load numbers into each space of a card which was purchased. The load mode allows the player to configure his own cards entering arbitrarily chosen numbers (within the required limits for each column) for each space of each card. This mode is constrained by the load time limit and if some cards or spaces remain unfilled when game time arrives they are automatically filled.

In any event, once all the purchased cards are loaded, the gaming board 12 enters the game mode routine in block A7. The play mode routine allows the player to enter card numbers, erase them, display all the purchased cards, advance through the gaming schedule, score bingos, play instant bingo, and other functions provided by the function key. If a bingo is scored, whether regular or instant, a bingo submode of the play mode routine is entered. A specific sequence of keypresses is then required to return the gaming board to the regular play mode routine. This specific sequence is generally provided by the validator after communications with the validation unit 14.

At any time while the gaming board is in the load or play mode routines, the system base unit 10 or validation unit 14 can initiate communications with the gaming card 12 causing it to enter the communications mode routine. For example if a bingo is scored it must be validated which requires communications with the validation unit 14. The return from the communications mode is always to the load mode routine which, depending if there are any new cards to input, either stays in the load mode until finished or goes directly back to the play mode. The sequence allows more cards to be added at any time to the gaming board 12 by a communications request and the correct command. A communications request for any other purpose does not alter the path because the program will continue directly through the load mode routine to the play mode routine if there are no cards to enter.

Simultaneously with the main software routine there is executed an interrupt routine which is entered on a real time basis from an internally generated timer interrupt. At every interrupt, or a predetermined number of interrupts, the program will branch to the routine and execute a keyboard scan routine in block A11, a display handler routine in block A13, and a real time clock routine in block A15. After these routines are executed the program returns to the main program at the location from which control was interrupted.

Thus, these processes are transparent to the operation of the main part of the program and facilitate its execution. To display a symbol on the display all that is needed is for the main program to store the appropriate symbol in certain memory locations. To use the keyboard, the main program just checks a memory location to see if the key is ready and another to fetch the key when one is present. Further to test how much time remains in the load mode, the main program just reads a memory location containing that value. The interrupt routine provides these functions while in the interrupt mode while allowing the main program to execute in the normal sequence.

The keyboard scan routine in block A11 checks the keyboard a number of times a second and determines whether there is a valid keypress. If there is a valid keypress a decoding routine places a number in a memory location indicating which key is activated.

The display handler routine in block A13 generates the four special signals LCDOSC, LCDDAT, ROWCLK, COLCLK necessary to maintain the display. Further it reads a set of memory locations, the display storage, to determine which symbols the display should show and converts that data to the LCDDAT signal.

The real time clock routine in block A15 is used to count interrupts to determine the passage of real time. Two counters are kept including a load time counter which counts down the load time variable communicated from the system base station 10 and an activity counter which determines the interval from the last key activation.

Figure 10:
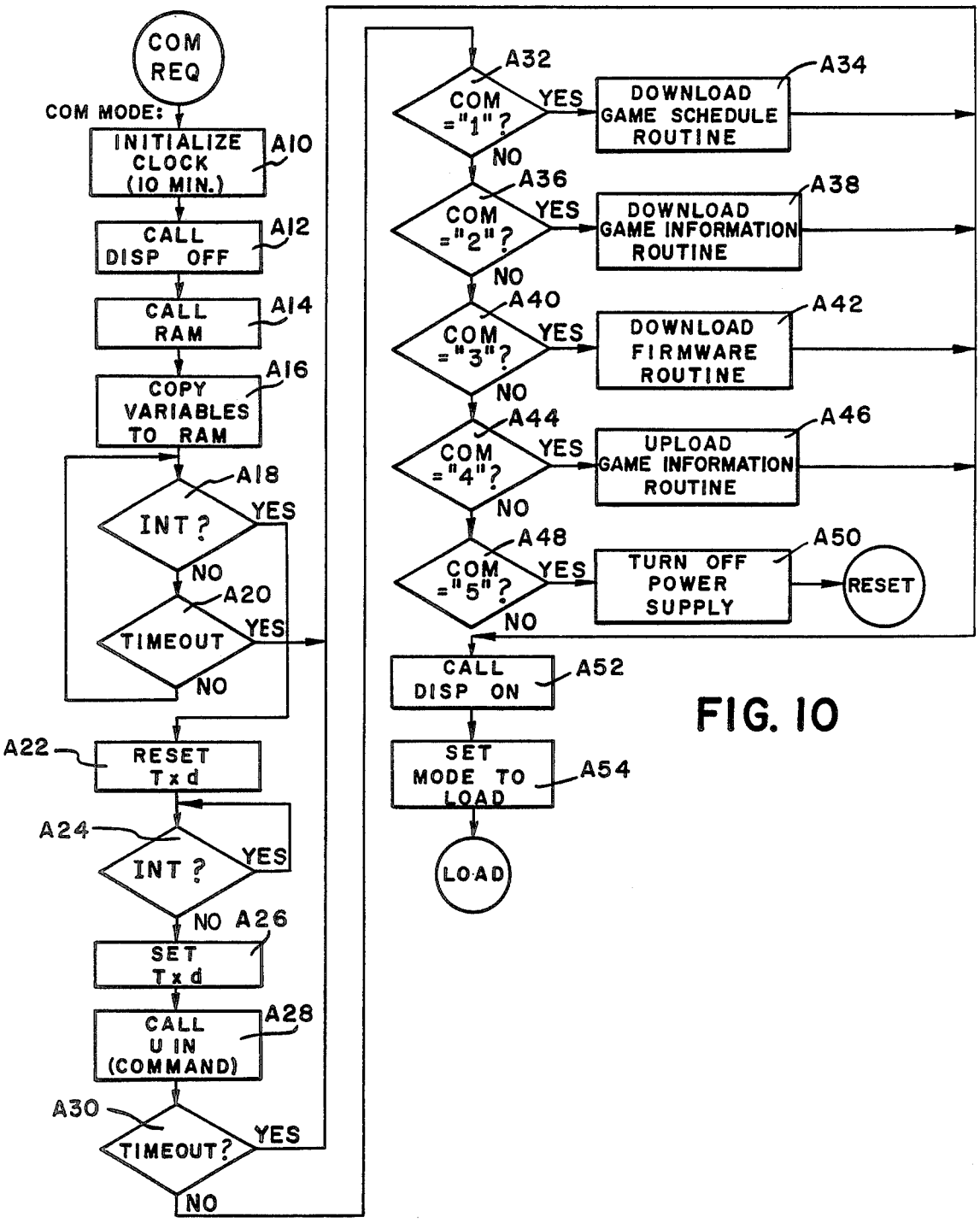
FIG. 10 is a more detailed flowchart of the communications mode routine illustrated in FIG. 9.

FIG. 10 is a detailed flow chart of the communications mode routine for the gaming board 12. The routine includes an initialization portion comprising blocks A10, A12, A14 and A16. In this initialization portion the activity counter is reset to ten minutes and the display is turned off. Thereafter, the external RAM is activated and initialized such that it can be used for the transfer of blocks of data. In block A18–A30 the communication linkage is developed to communicate with one of the external devices. In block A18 an interrupt is tested for, and if found, indicates an external device is requesting communications. Otherwise, the program loops through blocks A20 and A18 looking for either an interrupt or a time out. If the time out occurs first, then the control is transfered to block A52 and A54 where the display is turned back on and the gaming board 12 is set to the load mode.

However, if an external advice is attempting to communicate, then in block A22 the gaming board 12 will set its transmit line TxD to 0 to respond to the interrupt. The program thereafter loops in block A24 waiting for the interrupt on the RxD line to end. The disablement of the interrupt indicates that the external device has raised the Rxd line back to a logical 1 responding to the low logic level on the transmit line. Thus the gaming board will again reply in block A26 establishing the link by setting the transmit line Txd to a high logic level.

Next in block A28 a subroutine UIN is called to input a command byte. If the command is received without a time out, then the program begins the decoding it in blocks A32–A48. However, if the command is not received and there is an error in the communication then the program transfers control to block A52 which turns the display back on and transfers the gaming board 12 into the load mode. Depending upon the command value, the gaming board 12 either downloads a block of information, uploads a block of information, or turns off its power supply.

If the command is "1", as determined by an affirmative branch from block A32, then in block A34 the gaming board downloads the game schedule by calling the download game schedule routine. If the command is a "2", as determined by an affirmative branch from block A36, then in block A38 the gaming board downloads the game information by calling the download game information routine. Similarly, in block A40 an affirmative branch calls the download firmware routine in block A42 to transfer coding to the gaming board 12. On a command of "5", being found, control of the program is transfered from block A48 to block A50 where the power supply is turned off by resetting the power supply bystable. The commands "1", "2", "3", and "5" are generated to the gaming board 12 by the system base station 10. If the command is a 4 then the gaming board uploads game information in block A46 by calling the upload game information routine. A command of "4" is generated by the validation unit 14.

Figure 11A:
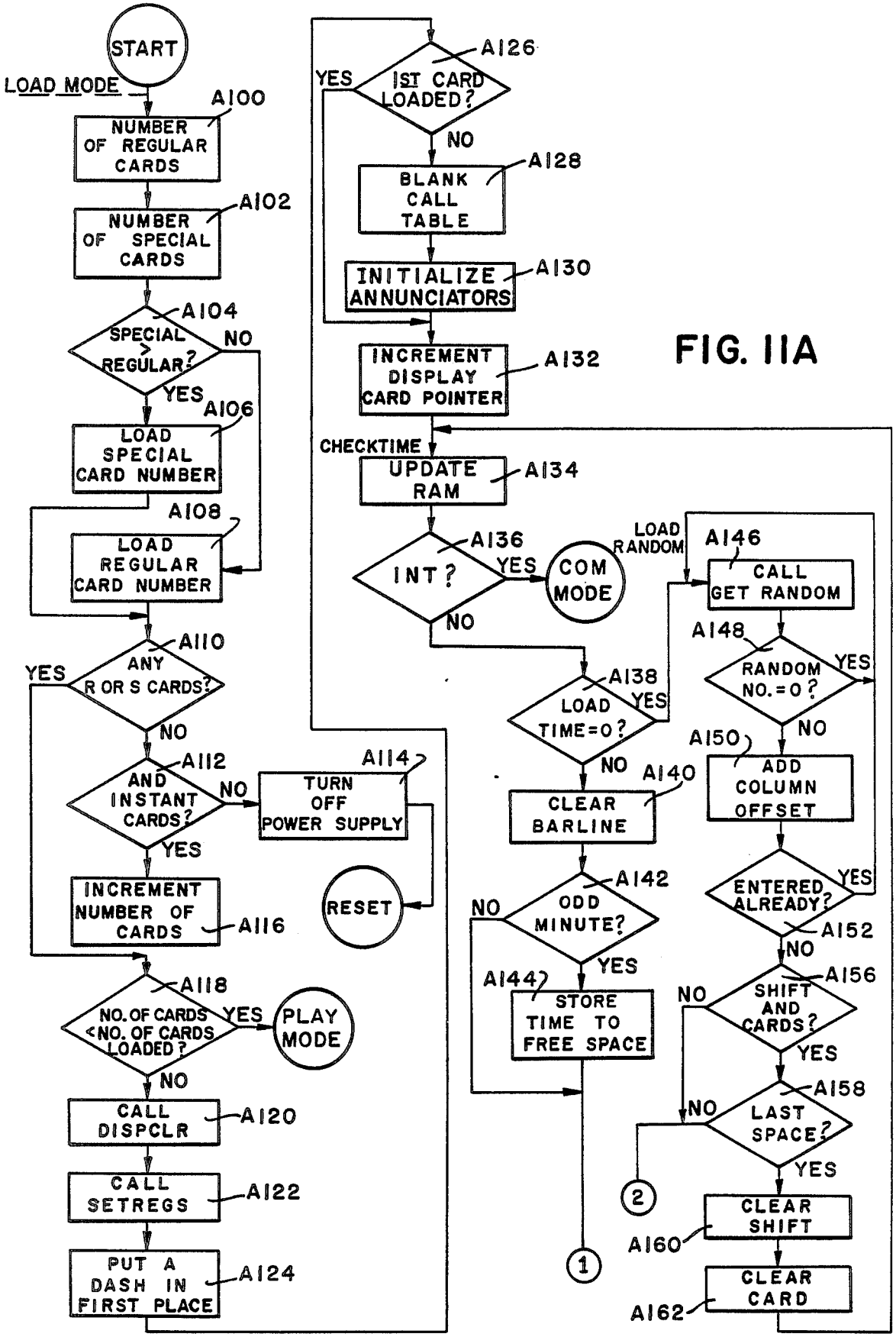
FIGS. 11A–11C are a more detailed flowchart of the load mode routine illustrated in FIG. 9.
Figure 11B:
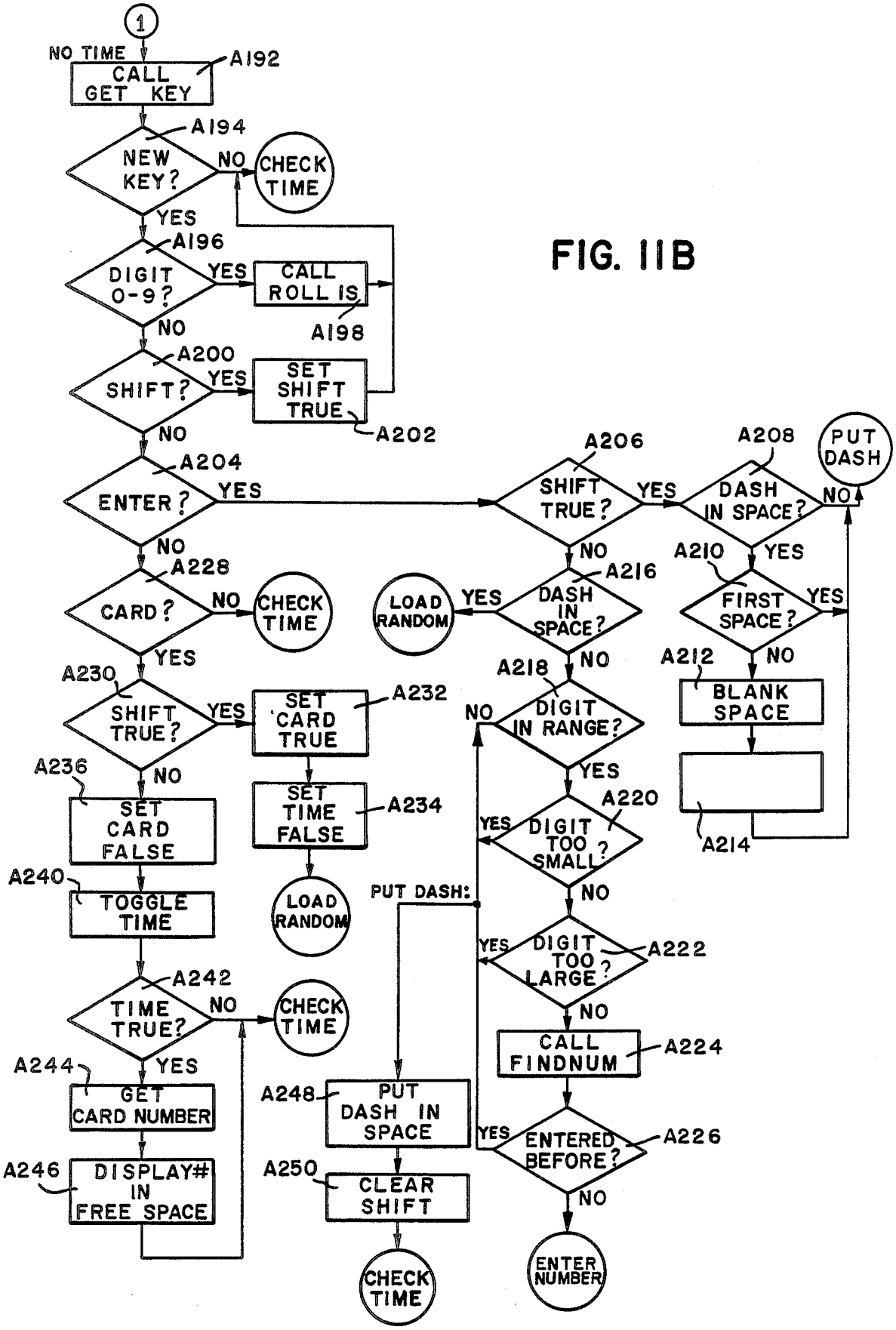
Figure 11C:
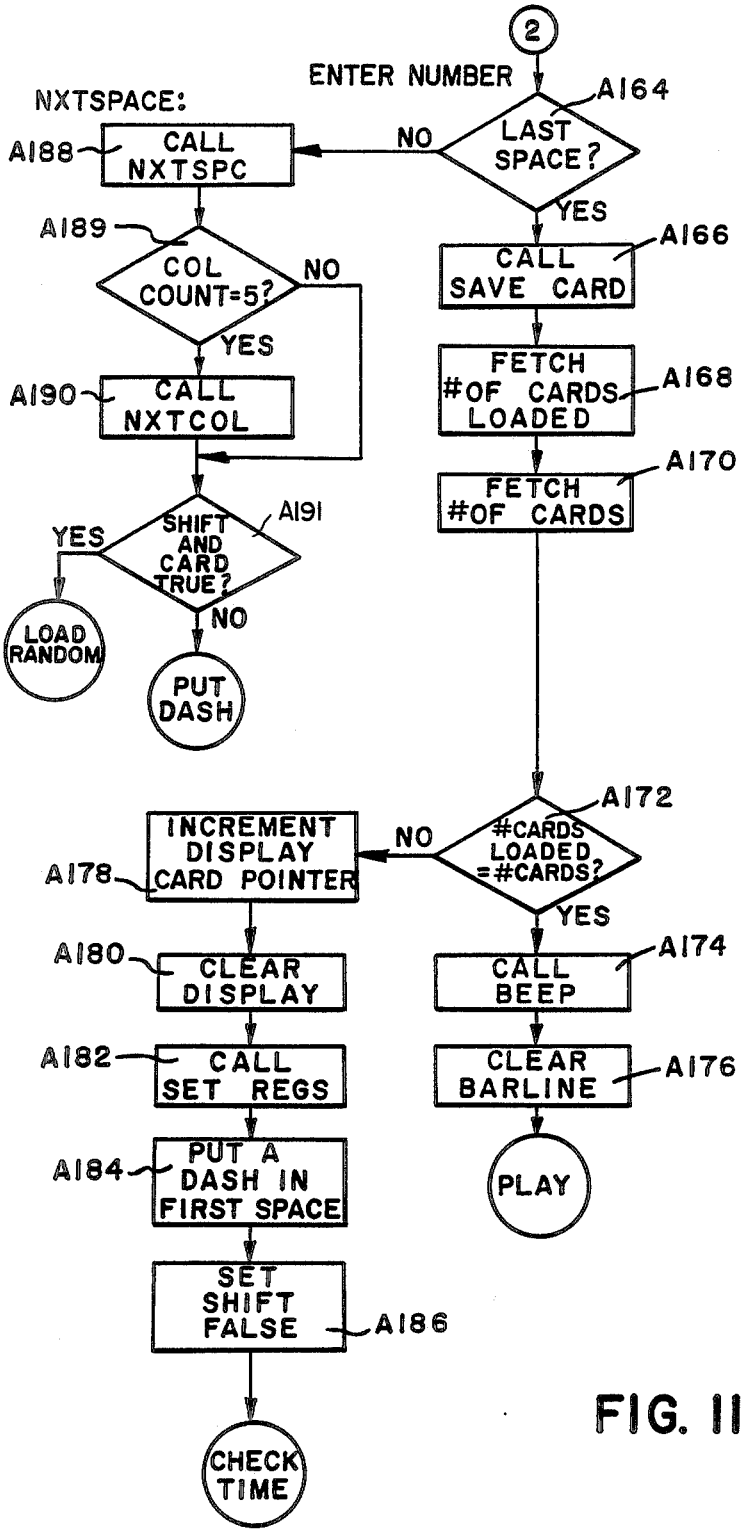

FIGS. 11A–11C are a detailed flowchart of the routine LOADMODE for the gaming board 12. The program begins by determining whether the number of special cards purchased is greater than the number of regular cards purchased in blocks A100–A104. If the regular card number is greater, it is loaded as the card number in block A108. Conversely, if the special card number is greater, it is loaded as the card number in block A106. When a special game is played, the number of special cards purchased is enabled from the total of cards loaded. When a regular game is played, the number of regular cards purchased is enabled from the total of cards loaded. Thus, the total of cards to be loaded is the greater of the regular number of special number.

The program next checks to see if there are any regular or special cards in block A110. If there are no regular or special cards to play and no instant cards, as determined in block A112, then the program turns the power supply off in block A114 to reset the gaming card 12. If there are no regular or special cards but there are instant cards, then the number of cards is incremented to one in block A116 to allow the player to load one card in order to play his instant cards. Otherwise, from block A110 the program will continue at block A118 where it is determined whether the number of cards loaded is greater or less than the number of cards purchased. A negative branch from this block is an indication that all the cards purchased have not yet had numbers selected for their array spaces and the loading loop should continue. However, if an affirmative branch from block A118 is taken, this is an indication that the loading is complete and the program should exit to the play mode.

The load loop continues by calling the subroutine DISPCLR in block A120 to clear the display and a subroutine SETREGS in block A122 to set the parameters for scanning a card in the registers. This initialization process is completed when a dash is put into the first space of the display in block A124 to prompt the player to begin entering numbers into a card. In block A126 the card which is being loaded is checked to determine whether it is the first card. If it is the first card, an initialization operation in block A128 blanks the call table so that when the gaming card 12 transfers control to the play mode that array will be clear. Further, the bar line or annunciators are cleared in block A130. Upon the second and subsequent passes through this loop, these blocks are by-passed by a negative branch from block A126 and the program goes directly to block A132 where the address pointer that indicates which card is to be displayed is incremented.

The program then enters the main load mode loop whose starting address is CHECKTIME. The loop begins in block A134 by updating the RAM and by checking for an interrupt in block A136. An interrupt indicates the connection of the gaming card 12 to either the system base station 10 or the validation unit 14. Upon finding an interrupt an affirmative branch from block A136 will transfer control of the program to the communication mode.

However, if there is no interrupt, the program advances normally to block A138 where it is determined whether or not the time for loading the gaming board 12 has expired. If it has, an affirmative branch transfers the program the address LOAD RANDOM at to block A146 and, if it has not, the regular path of the program is to block A140 where the annunciator line is cleared. Next, the load time is checked to determine whether it is odd or even. If at an odd minute the time is stored in the free space in block A144. If the time is even then the program continues and by-passes block A144. This operation allows the gaming card 12 to update the display in the free space to indicate to a player the number of minutes remaining in the load mode.

Thereafter, in block A192, the subroutine GETKEY is called to obtain a keypress from the scanner routine. Block A194 determines whether a new key has been entered and, if not, the program loops back to the address CHECKTIME. The program continues this loop until a new keypress causes an affirmative branch from block A194 to be taken indicating a new key was found. The new key is then decoded by a number of tests to determine whether it is a numerical digit or a functional command. Usually, the key tested is a digit as determined in block A196 and a subroutine ROLLIS is called in block A198 to roll the digit into the free space before entry in a space. Thereafter, the program exits to the address CHECKTIME.

If the keypress was not a digit, it is checked again in block A200 to determine whether it is a shift command. If the key is a shift command, then in block A202 the annunciator bit for the shift operation is set true before the program exits to the beginning of the loop at the address CHECKTIME. A keypress that is neither a digit nor a shift is checked in block A204 to determine whether the operation was an enter key.

The normal operation for the program, if an enter key has been pressed, is to enter the digits input for an array space into the card presently displayed and this path begins at block A206. The program first determines whether the shift bit is true. If the shift bit is not true, then in block A216 it is determined whether there is a dash in the space. A dash in the space instead of a number is an indication for the program to load a random number into that particular array location of the card and thus, the program branches to address LOAD RANDOM at block A146 for that operation. However, if there is no dash in the space, the digit keypress is then checked in blocks 218, 220, and 222 to determine if it is in a normal range and not too small or too large. If any of these tests are failed, a dash is placed in the space instead of a digit in block 248 and the shift bit is cleared in block A250 before looping back to the address CHECKTIME. This will cause a refusal of the gaming board 12 of the number on next pass through the program.

However if the number to be entered is valid, then in block A224 a subroutine labeled FINDNUM is called to determine whether the digit has already been entered. If it has, a branch from block A226 exits to block A248 so that the number will be refused entry. If the number has not been entered then the digits are entered into the card array.

If the program has determined this is the last space of the present card in block A164 then control is transfered to block A166. However, if the card is still being filled, the subroutine NXTSPC is called in block A188 to point to the next array space to be filled. Thereafter, the program checks to determine whether the column count is five in block A189 before continuing. A count of five indicates that the program has loaded an entire column and therefore must shift to the next column by calling the subroutine NXTCOL in block A190.

The program then checks to determine if the shift bit and card bit are true. If both are true, the program jumps to the address LOADRANDOM to insert random numbers in the card. Otherwise, the program branches to the address PUTDASH in block A148 to insert a dash in the next space prompting the player to fill the space. The shift bit is cleared in block A250 before exiting to the beginning of the load loop at the address CHECKTIME.

This loop is continued until all the spaces of one card have been loaded either with random numbers or with those arbitrarily selected by a player while checking for duplicates and while ensuring that each number is within the correct range. When all spaces of a card have been filled the test in block A164, which asks whether this is the last space, obtains an affirmative response. A subroutine SAVECARD is called in block A166 to save those numbers that have been inputed for the card. This card is now complete and will be playable on a shift to the play mode of the gaming board 12.

Thereafter, the number of cards loaded and the number of cards purchased are fetched in block A168 and block A170, respectively, and compared in block A172. If they are equal, then an affirmative branch from block A172 indicates that all the cards purchased have been loaded and it is now time to enter the play mode. Therefore, the program will call the subroutine BEEP to produce an audible sound with the tone generator and alert the player that he can now use the card for play. The program clears the bar line in block A176 before exiting to the play mode from this path.

If all the cards have not been loaded, as determined by negative branch from block A172, then the display card pointer is incremented in block A178 to point to the new card and the display is cleared in block A180. The next interrupt to the display routine will then cause this card to be displayed. The subroutine SETREGS is then called in block A182 to initialize the registers for counting the spaces and columns for the card. In block A184 a dash is put in the first space of the new card to prompt the player to begin entering the numbers and the shift bit of the annunciator bar is cleared in block A186 before exiting. This initializes the new card for loading. The loading of the new card is as described previously until all purchased cards have been loaded.

The program path for loading a random number in a space will now be more fully explained. As was indicated previously, for example at block A126, there are certain parts of the program which, check to determine if the player has made a mistake or has not put in a correct number and insert a dash into the memory location where the gaming board expects a number to be. If the program finds a dash in the space it will jump to the address LOADRANDOM to load a random number. Further, the program at block A138 determines whether the time for loading the card has expired. If it has and not all spaces of the cards have been loaded then it too will transfer control to the address LOADRANDOM to load a random number. Further, the player may voluntarily by pressing the sequence of function keys shift-enter load random numbers in a particular spaces instead of a selected. Additionally, the player may enter random numbers for an entire card by operating the key sequence shift-card-enter.

All of these program paths converge at block A146 where the subroutine GETRANDOM selects a random number between 0 and 15. This software random number generation provides an ease of operation for the gaming card 12, and allows a player to continue play even if he has made a mistake or does not want to enter arbitrary number selections into the cards. When the subroutine returns with a random number, the number is first checked in block A148 to determine if it is 0. Since 0 is not a valid input to a card, the program loops back to block A146 to find another number. Once the subroutine returns with a non-zero random number, it is added to a particular column offset in block A115 for the space that the program is loading. That number is then checked with the subroutine FINDNUM in block A152 to determine if it has already been entered into the card. If so, the program sequence returns to block A146 to begin to find some non-zero random number for that particular column which has not already been entered.

When such a number is obtained, the program sequences to block A156 to determine whether the shift bit and card bit are set. If they are not set, then the program enters the number by transfering control to block A164 as described previously. If the shift and card bits are set, then in block A158 the program determines whether this is the last space for a card. If it is the last space for a card and the shift and card bit are set, an entire card has been entered with random numbers and the next card should be displayed for manual choice. Therefore, the shift bit and the card bit are cleared in block A160 and block A162 prior to exiting to the load loop at address CHECKTIME. If, however, the last space for the card to have random numbers generated for it has not been reached, then the number is entered by transfering control to block A164 and the address ENTERNUMBER so the loop will continue.

If the program finds that the key that was entered was the card key the program advances from block A228 to block A230. However, if the program does not recognize the key at this point the load loop is reentered by transfering control from block A228 to the address CHECKTIME. When the card key is recognized at block A230, a test to determine whether the shift bit is true is performed. If this condition is present then the player has selected a shift-card sequence of a key presses which commands the gaming board to enter random numbers into the particular card that is being displayed. The program therefore sets the card annunciator bit true in block A232 and sets the time annunciator bit false in block A234 before exiting to the random number generator at the address LOADRANDOM.

However, if the shift is not true then the player has requested that the present card number be displayed in the free space. This operation is performed by the path including blocks A236 and A240 which sets the card annunciator bit false and toggles the time bit. Next, a test is used to determine whether the time bit is true before either displaying the card number or going to the beginning of the load loop at the address CHECKTIME. If the time bit is still true, then the program gets the present card number in block A244 and displays that number in the free space in block A246. The exit from this path is then to the beginning of the load loop at address CHECKTIME.

FIG. 12 is a detailed flow chart of the PLAYMODE for the gaming card 12. The program first clears the flag bits F0 and F1 in block A300 to set the PLAYMODE. Next in block A302, the barline is tested to determine if it is clear. If the barline is clear, this is an indication that this pass is the first time through the PLAYMODE which requires a number of parameters to be initialized. This initialization process is performed in blocks A310–A318 where the memory locations storing the entry of a character and the free space are cleared, the enter flag is set, and the number of the card to be displayed is set to 1. Thereafter, a subroutine labeled GET CARD is called to obtain the stored numbers for the first card so that they can be either matched or displayed. The subroutine GET CARD moves the array symbols form card storage to display storage. Further, the type of card is fetched by calling a subroutine labeled GET TYPE.

After the initialization, the program transfers control to block A304 where the RAM memory is updated. If this is not the first pass through the PLAYMODE then the negative branch from block A302 directly transfers control to block A304. After initialization of the RAM in block A304, an interrupt is tested for in block A306. If the interrupt is being present, this indicates that the gaming board 12 is connected to either the system base station 10 or the validation unit 14 and a communication request is present. The gaming card will in response to the request exit to the communications mode. If there is no communication request, the program in block A308 calls the subroutine GET KEY which reads the key input from the key scan routine. Block A320 determines if a new key has been input. Upon the receipt of a new key it is saved in block A322, otherwise the program returns to the address PLAYLOOP. In this manner the program will continously scan for a new key and if it does not find one, return to the beginning of the loop to check for a communication request.

After a new key has been found, the program then continues to block A324 where the status of the gaming board is determined by fetching the annunciator byte. In block A326 the status bits are tested to determine whether BINGO is set and whether the instant annunciator is set.

If the bingo annunciator is not set and the instant annunciator is set, the program has determined by an affirmative branch to block A328. The program next tests the key input to determine if it was merely a key release in block A330. If the new key is merely a release of the present key, the program will exit back to the address PLAYLOOP. However, if there is an actual new key and the instant annunciator is set then the program will being to play instant BINGO. This loop is entered through block A332 where the address ICNTR is tested to determine whether it is zero. This address is used to store the number of key pushes that a player is allowed in an attempt to win at an instant game. If the instant counter is zero, as determined by an affirmative branch from block A332, then the game is finished and the instant bingo flag is cleared in block A346. Further, in block A348 a buzzing sound is generated to alert the player that he has lost the instant game. Next, in block A350 a subroutine GETCARD is called to obtain the next card in line, so that if there are more instant bingo games, the program re-enters this mode. Before leaving the loop, at block A352 the shift bit is set false.

However, if the instant counter is not zero, the player still has a number of pushes with which to win at the instant bingo. Therefore, the negative branch from block A332 continues the program at block A334 where the counter ICNTR is decremented. This number is then set into the free space in block A336 to inform the player of how many pushes his is still allowed. Thereafter, in block A338 the subroutine DOIB is called to select a random number and to match it against the card in play. The subroutine DOIB returns to the main program loop with either the accumulator set to 0 or 1 indicating that instant BINGO has been lost or won, respectively. When the program returns with the accumulator set to 1, program control is transferred to block A342 where the BINGO annunciator is set. To alert the player that a bingo for the instant mode has been found, a characteristic tune is played in block A344 with the tone generator by calling the subroutine BMUSIC. Thereafter, the program exits back to PLAYLOOP while setting the shift annunciator bit in block A352.

When it is determined that the instant annunciator has not been set and the gaming board is either in a bingo or not bingo mode, the program will continue to block A354 where the status of the board is tested. The annunciators are fetched in block A354 and tested in block A356 to determine whether the instant and BINGO annunciators are both set. If both the instant and bingo annunciators are set then the gaming board 12 should not input a key stroke and thus the program loops back to the address PLAYLOOP unless the digit is 0. In block A358 this test is performed to determine whether this input is zero which is the start of a 0-SHIFT-ENTER sequence which will reset the gaming board 12 from the BINGO mode to the regular PLAYMODE.

Thereafter, the gaming board begins a path in blocks A360–A378 which decodes the entered key. If the entered key a digit between 0 and 9, control will be transferred to block A416. If the key entered is a shift command, as sensed in block A362, then control will be transferred to block A366. If the command is an enter operation then control will be transferred from block A364 to block A368.

At this point the program determines whether the instant annunciator bit is set in A370. If the annunciator bit is true then the program loops back to the playloop address PLAYLOOP. However, if the annunciator bit is false, the program will continue decoding the new input key. In block A372 the recall instruction is decoded and control transferred to block A426 if the test is affirmative. In block A374 the game key is tested for and a path beginning with block A436 initiated if the test is true. In block A376 the level key is tested for and if the test is affirmative, control transferred to block A440. The last key operation to be tested for is the card function in block A378. A routine beginning at block A456 is entered if the new key was the card key.

However, if none of these keys have been entered then the gaming board determines that an invalid key request has been made and resets the bar line in block A380. Further, the recall mode is reset by clearing the function bit F0 in block A382. The key that was entered is displayed in block A384 before the program transfers to the address PLAYLOOP.

If the key entered was determined to be a numeric digit between 0 and 9, block A416 is executed where the enter bit is cleared. Block A418 checks for a previous enter bit and if there is one, the program clears the free space in block A420. Next, in block A422 the entered digit is rolled into the left hand side of the free space by subroutine labeled ROLLIS 1. Generally, if the player is entering two digits, this loop is re-executed and the ROLLIS 1 subroutine rolls the second digit in the free space such that that number can be entered. The digit that is in the free space is then saved in the entry location ENTRY in block A424 before the program exits to the address PDONE.

If the key that was entered is the shift key, then in block A366 the shift bit is set true before exiting to the address PLAYLOOP. Likewise, the enter flag is set in block A368 if the key which was pressed is the enter command. Control is then transferred to block A386 where the last digit entered is checked to determine whether it is 0. If it is, then a path beginning at block A410 is entered to determine whether the special sequence of 0-SHIFT-ENTER has been input to remove the gaming card from the Bingo Mode. If not, then the negative branch from block A410 exits to the address PDON. If this sequence has been input, then the gaming card 12 signals the player and floor worker with a beep by calling the subroutine BEEP in block A412.

Generally, this sequence is used to reset the card after a BINGO has been validated by the instant annunciator bit is not set, then the program again resumes its search for any other bingos by calling the subroutine BCRESUME in block A396. The subroutine BCRESUME checks the rest of the cards to determine if there are any regular bingos. If there is, a regular bingo is indicated by the accumulator having a 1 in it from the return of the subroutine. The program transfers control to block A342 where the BINGO annunciator is set and the bingo tune is played by calling the subroutine BMUSIC in block A344. However, if no BINGO is found in the rest of the cards and the instant annunciator bit was not set in block A414, then the instant and bingo annunciators are cleared in block A400 before the program exits to the address DCX. A exit to this address produces a call to the subroutine GETCARD to set the next card in block A350 and then clears the shift annunciator in block A352 before exiting to PLAYLOOP.

If the enter operation is a normal operation to input a called number to be checked against the cards, then in block A386 the negative branch of that test continues the program to block A388, and if there are no cards to be played, the program exits to the address PLAYLOOP. However, if there are cards and the shift annunciator is not true, as tested in block A390, then the program will continue to block A402. In that operation the bingo annunciator will be tested to determine if it is true. A true bit will cause the program to exit to address PDONE.

If the bingo annunciator bit is not set, indicating a regular entry of a called number, then the subroutine ENTRCALL will be called in block A404. This subroutine enters the two digits of a called number into the calltable so that all the enabled BINGO cards in present play can be checked against the call table. After the bit in the call table is set, the table is matched against all the cards by a subroutine labled BINGCHECK in block A406. The subroutine BINGCHECK will return with the accumulator set at 1 if a BINGO is found. This condition is tested for in block A408 and transfers control to the address BINGO when the bit is present. If there is no bingo at this point, then the program loops back to block A400 where the instant flag and the bingo flag in the annunciator bar are cleared. The program thereafter, exits to the address PLAYLOOP after performing the operations of blocks A350, A352.

Figure 13:
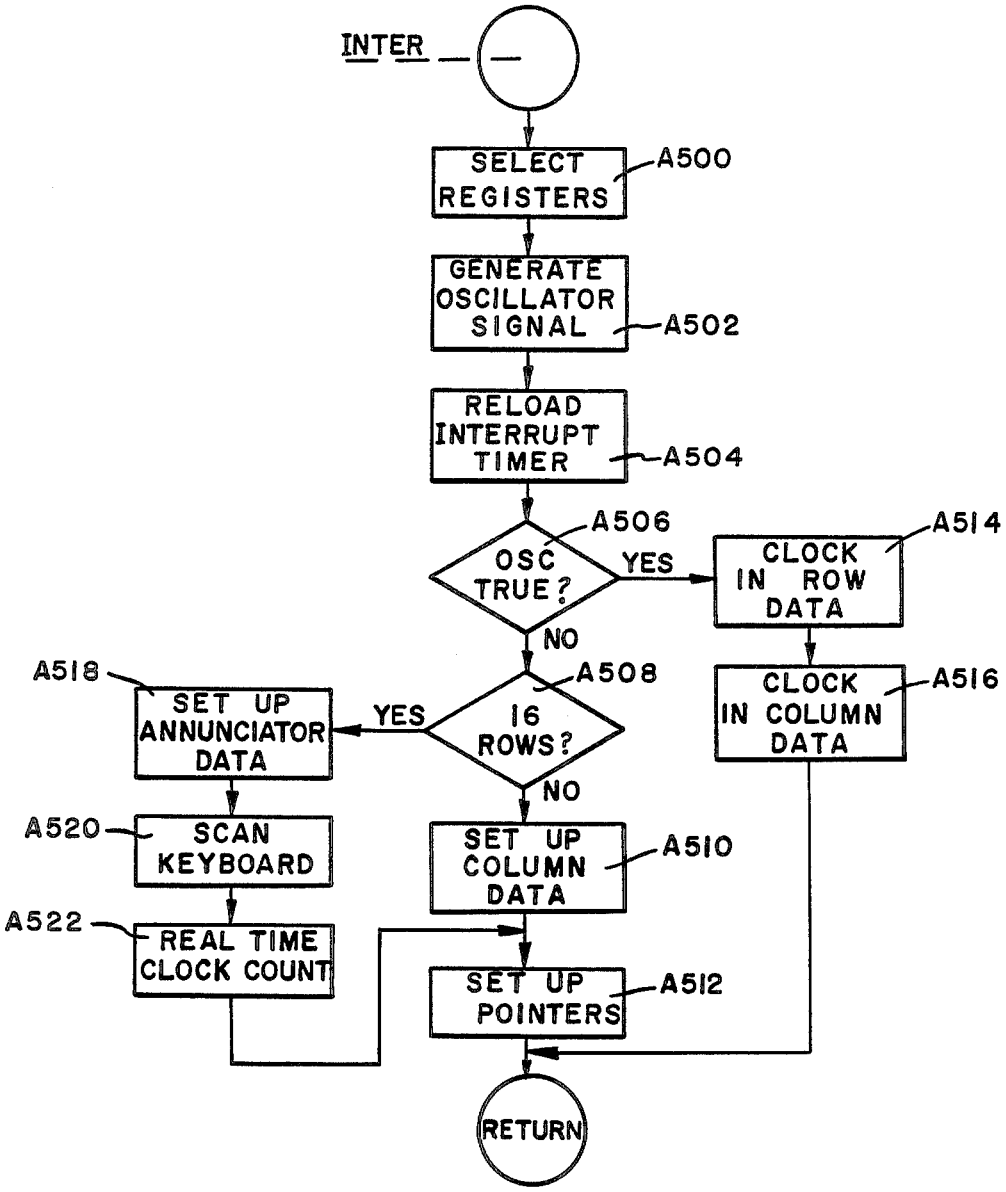
FIGS. 13A–13C are a more detailed flowchart of the interrupt routine illustrated in FIG. 9.

FIG. 13 is a more detailed flowchart of the interrupt routine illustrated in FIG. 9. When an interrupt occurs from the internal timer control program is transfered to block A500 where the background bank of registers is selected. This register bank is used by the interrupt routine which may store information between interrupts. Therefore, the main routine should operate without using these registers and changing this data. Next, in block A502 the routine generates the oscillator signal LCDOSC from pin P20 of the microprocessor 300. The master time clock for the display must be toggled precisely every 960 microseconds and cannot wait until other tasks in the main program are completed. Therefore, the counter-timer circuit inside the microprocessor 300 is used to generate an interrupt every 960 microseconds. After the oscillator signal has been generated the timer is reloaded to begin timing for the next interrupt by the operation in block A504.

Alternate paths are now taken from block A506 depending upon a test that determines whether the oscillator logic level is a 1 or a 0. If the value of LDCOSC is 0 then a string of column data is prepared in block A510 to be sent to the LCD driver circuits on the next interrupt. If, however, LCDOSC is a logical 1, the previously prepared data is shifted into the driver circuits in blocks A514 and A516. The data set up routine performs two slightly different tasks when setting up data for the display. First, it sets up segment data to form the seven segment digits and secondly, it sets up the data for the annunciator bar. The data set up for the seven-segment digits is accomplished 15 out of 16 passes through the loop and the data for the annunciator is set up only during the 16th time through. Further, when the annunciator data is set up on the 16th pass, the keyboard scan and real time clock functions in blocks A520 and A522, respectively are performed. The tests for the number of passes is accomplished in block A508 which transfers control either to block A518 or block A510 depending upon the number of passes through the loop.

The data to be displayed is stored in the 26 bytes of the display storage. As set forth previously, the display storage is logically organized as five groups of five bytes where each byte holds two digits. There is also one byte holding the eight annunciator bits. In this manner, the main program merely writes a byte to the appropriate location in the display storage and it will show up on the display through the efforts of the interrupt driven display routine. The display data set up routine in block A510 and block A512 steps through a group of five bytes and looks up the appropriate segment bits from a table and places them in a segment storage area where they will be sent to a display hardware on the next interrupt by the transmit routines in block A514 and block A516. On the 16th time through the set up routine the lookup table is addressed for the bits for the annunciator.

Every 32nd interrupt the keyboard scan and real time clock routines in blocks A520 and A522 are executed. The keyboard scan loop probes each of the four rows of the 4×4 keypad with a low logic level and looks for a low logic level on one of the column pins. If exactly one row makes exactly one column go low, then one and only key has been pressed. The row/column pattern is converted to a numerical value by means of a lookup table. If the same key is found actuated on two consecutive passes through the keyboard scan routine, then a valid key is detected. If a transition from an invalid to a valid key is detected, then a flag byte is set to inform the main program that a new key is available. At the same time the activity counter is reinitialized to ten minutes.

The real time clock routine follows the keyboard scan. Each pass through the real time clock routine an interrupt is counted which represents 1/33 of a second. When a second has been counted the two counters are updated and can be tested by the main routine to determine the amount of time left in the load mode and the interval since a key activation. When the activity counter times out, indicating that a key has not been pressed for ten minutes, the gaming board 12 turns off the display power supply to conserve power and the microprocessor 300 enters an idle loop. In this idle loop, this microprocessor 300 waits for a key to be pressed or an external device to communicate with. If neither of these events happen for two hours, then the microprocessor 300 will turn the main power supply off and completely power down. If a key activation occurs between the time the display power supply is turned off and the main power supply is turned off, then the gaming board simply returns to normal operation and executes the required operations for handling the key. However, once the main power supply has been shut off, it will require a reconnection and initialization with the system base station 10 before power can be turned back on.

While a preferred embodiment of the invention has been illustrated, it will be obvious to those skilled in the art that various modifications and changes may be made thereto without departing from the spirit and scope of the invention as defined in the appended claims.

What is claimed is:

1. A chance based gaming board comprising:

display means including means for visually displaying a plurality of symbols in a predetermined array of symbol display locations;

computer means including a control program, processor means controlled by said control program, data storage means including a plurality of symbol storage locations, and means for generating control signals;

input switch means for entering into said data storage means a plurality of symbols including data and function commands;

means for selecting a first load mode for the gaming board;

said processor means, in response to said load mode, generating control signals causing the present state of said input switch means to be periodically sensed, causing said data storage means to store entered symbols in a selected sequence in said symbol storage locations, and causing said display means to display said entered symbols in said predetermined array;

means for selecting a second play mode for the gaming board;

said processor means, in response to said play mode, generating control signals causing the contents of each symbol storage location to be compared with said entered symbols, causing a symbol storage location to be marked if said comparison locates an indentical match; causing said display means to visually display marked symbol storage locations differently from the display of unmarked symbol storage locations; and further causing the pattern of said marked symbol storage locations to be compared with a predetermined pattern forming a plurality of locations of said symbol array, and causing an annunciation if said pattern comparison locates an indentical match;

means for selecting a third communications mode for the gaming board adapted to upload or download information with an external device; and said processor means generating control signals to store a gaming schedule comprising a plurality of win patterns in said data storage means during said communications mode and generating control signals during said play mode to execute said gaming schedule.

2. A chance based gaming board as set forth in claim 1 wherein said gaming schedule comprises: a sequence of at least one win pattern per game which can be automatically executed by said gaming board.

3. A chance based gaming board as set forth in claim 2 wherein:

said win pattern defines a format of a plurality of related array configurations which can be a win pattern.

4. A chance based gaming board as set forth in claim 2 wherein:

in response to one of said function commands of said input means, said processor means generates control signals causing the next win pattern in said schedule to be played.

5. A chance based gaming board as set forth in claim 1 which further comprises:

means for limiting the length of time of said gaming board in the loading more including means for decrementing a timing word stored in said data storage means and means for transferring said gaming board from said load mode to said play mode upon the expiration of the interval represented by said timing word;

said processor means, during said communications mode, generating control signals for storing said timing word representing a variable time interval from a fixed actual time.

6. A chance based gaming board as set forth in claim 5 which further includes:

random selection means for storing random symbols in any unfilled locations of said symbol array locations in response to the expiration of said timing word.

7. A chance based gaming board as set forth in claim 1 which further comprises:

random selection means, operable during said loading mode, for storing random symbols in any unfilled locations of said symbol array locations in response to the entry of a predetermined sequence of symbols from said input means.

8. A chance based gaming board as set forth in claim 1 which further comprises:

mean for storing in said data storage means a record of the status of said gaming board when said pattern comparison locates an identical match.

9. A chance based gaming board as set forth in claim 8 wherein said status record includes:

an indication of the location in said gaming schedule where said match occurred.

10. A chance based gaming board as set forth in claim 9 wherein:

said processor means, in response to a command during said communications mode, generates control signals causing said status records to be output to an external device.

11. A chance based gaming board as set forth in claim 10 wherein:

said processor means, in response to a command during said communications mode, generates control signals causing the storage of initialization information from said external device.

12. A chance based gaming board as set forth in claim 11 wherein:

said initialization information includes a validation code which defines a particular gaming session.

13. A chance based gaming board as set forth in claim 12 wherein:

said initialization information includes an assignment code which defines a particular player and gaming board for a gaming session.

14. A chance based gaming board as set forth in claim 13 wherein:

said status records include said initialization information.

15. A chance based gaming board comprising:

display means including means for visually displaying a plurality of symbols in a predetermined array of symbol display locations;

computer means including a control program, processor means controlled by said control program, data storage means including a plurality of symbol storage locations, and means for generating control signals;

input switch means for entering into said data storage means a plurality of symbols including data and function commands;

means for selecting a first load mode for the gaming board;

said processor means, in response to said load mode, generating control signals causing the present a state of said input switch means to be periodically sensed, causing said data storage means to store entered symbols in a selected sequence in said symbol storage locations, and causing said display means to display said entered symbols in said predetermined array;

means for selecting a second play mode for the gaming board;

said processor means, in response to said play mode, generating control signals causing the contents of each symbol storage location to be compared with said entered symbols, causing a symbol storage location to be marked if said comparison locates an identical match; causing said display means to visually display marked symbol storage locations differently from the display of unmarked symbol storage locations; and further causing the pattern of said marked symbol storage locations to be compared with a predetermined pattern forming a plurality of locations of said symbol array, and causing an annunciation if said pattern comparison locates an identical match;

a display power supply for energizing said display from a battery source;

means for turning said display power supply on and off which are controlled by said processor means;

a main power supply for energizing said processor means and said data storage means from said battery source;

means for providing communications between said processor means and an external device;

means for turning said main power supply on and off which is controlled by said processor means and said communications means, said communications means turning said main power supply on by connection to said external device;

said processor means generating control signals to turn said display power means off if said input switch means has not entered a symbol for a first interval of time; generating control signals to turn said display power on if said input means enters a symbol between said first interval and a second interval; and generating control signals to turn said main power supply off if said input means has not entered a symbol for said second interval of time.

16. A chance based gaming board comprising:

display means including means for visually displaying a plurality of symbols in a predetermined array of symbol display locations;

computer means including a control program, processor means controlled by said control program, data storage means including a plurality of symbol storage locations, and means for generating control signals;

input switch means for entering into said data storage means a plurality of symbols including data and function commands;

means for selecting a first load mode for the gaming board;

said processor means, in response to said load mode, generating control signals causing the present state of said input switch means to be periodically sensed, causing said data storage means to store entered symbols in a selected sequence in said symbol storage locations, and causing said display means to display said entered symbols in said predetermined array;

means for selecting a second play mode for the gaming board;

said processor means, in response to said play mode, generating control signals causing the contents of each symbol storage location to be compared with said entered symbols, causing a symbol storage location to be marked if said comparison locates an identical match; causing said display means to visually display marked symbol storage locations differently from the display of unmarked symbol storage locations; and further causing the pattern of said marked symbol storage locations to be compared with a predetermined pattern forming a plurality of locations of said symbol array, and causing an annunciation if said pattern comparison locates an identical match;

a main power supply for energizing said processor means and said data storage means from a battery source;

means for providing communications between said processor means and an external device;

means for turning said main power supply on and off which are controlled by said processor means and said communications means, said communications means turning said main power supply on by connection to said external device; and said processor means generating control signals to turn said main power supply off in response to a command transmitted over said communications means from said external device.

17. A chance based gaming board as set forth in claim 16 wherein:

said processor means generates control signals to turn said power supply on in response to receiving initialization information over said communications means from said external device.

18. A chance based gaming board as set forth in claim 17 where:

said initialization information includes a validation code which defines a particular gaming session.

19. A chance based gaming board as set forth in claim 18 wherein:

said initialization information includes an assignment code which defines a particular player and gaming board for a gaming session.

20. A chance based gaming board comprising:

display means including means for visually displaying a plurality of symbols in a predetermined array of symbol display locations;

computer means including a control program, processor means controlled by said control program, data storage means including a plurality of symbol storage locations, and means for generating control signals;

input switch means for entering into said data storage means a plurality of symbols including data and function commands;

means for selecting a first load mode for the gaming board;

said processor means, in response to said load mode, generating control signals causing the present state of said input switch means to be periodically sensed, causing said data storage means to store entered symbols in a selected sequence in said symbol storage locations, and causing said display means to display said entered symbols in said predetermined array;

means for selecting a third second play mode for the gaming board; and means for selecting a instant mode;

said processor means, in response to said instant mode, generating control signals causing the random selection of one of said symbol storage locations for an entry of a symbol from said input means, causing said display means to visually display selected symbol storage locations differently than the display of unselected symbol storage locations, causing the pattern of said selected symbol locations to be compared with a predetemrined pattern forming a plurality of locations of said symbol array, and causing an annunciation if said pattern comparison locates an identical match.

21. A chance based gaming board as set forth in claim 20 which further comprises:

means for selecting a communications mode for the gaming board;

said processor means, in responsse to said communications mode, generating control signals causing information to be stored to or retrievd from said data storage means.

22. A chance based gaming board as defined in claim 21 wherein:

said processor means, in response to said communications mode, stores an instant count in said data storage means indicating the number of times said instant mode can be selected.

23. A chance based gaming board as defined in claim 22 wherein:

said processor means, in response to said communications mode, stores a input count indicating the number of random selections allowed to match said predetermined pattern.

* * * * *

UNITED STATES PATENT AND TRADEMARK OFFICE

CERTIFICATE OF CORRECTION

PATENT NO. : 4,747,600 Sheet 1 of 7

DATED : May 31, 1988

INVENTOR(S) : John Richardson

It is certified that error appears in the above-identified patent and that said Letters Patent is hereby corrected as shown below:

IN THE SPECIFICATION:

Column 1, line 1, change "ELECTRONICS" to --ELECTRONIC--;
line 22, change "connot" to --cannot--.
Column 3, line 32, change "developes" to --develops--;
line 39, change "a" to --an--.
Column 4, line 10, change "number" to --numbers--;
line 24, change "accomodate" to --accommodate--;
line 31, after "cards" insert a comma;
line 38, after "level" insert --or--;
line 40, change "with" to --by--;
line 42, change "chosing" to --choosing--;
line 48, delete "of".
Column 5, line 36, change "a" to --an--;
line 40, change "based" to --base--;
line 43, change "transfered" to --transferred--.
Column 6, line 3, change "13A-13C" to --13--;
line 30, delete "station";
line 35, change "optionally" to --optional--.
Column 7, line 24, change "bytes" to --byte--;
line 46, change "interfall" to --interface--
lines 52-53, change "annuciator" to --annunciator--;
line 53, change "morefully" to --more fully--
line 64, delete "either".
Column 8, line 6, after "addition" insert a comma;
line 29, change "(LED)" to --(LCD)--;
line 64, delete "the";
line 68, change "level/place" to --level, or place--.

UNITED STATES PATENT AND TRADEMARK OFFICE

CERTIFICATE OF CORRECTION

PATENT NO. : 4,747,600 Sheet 2 of 7

DATED : May 31, 1988

INVENTOR(S) : John Richardson

It is certified that error appears in the above-identified patent and that said Letters Patent is hereby corrected as shown below:

Column 9, line 22, change "chosing" to --choosing--;
line 57, delete "indication".
Column 10, line 30, after "display" insert a semicolon;
line 30, change "mode" to --mode, it--;
line 54, after "and" insert --is--.
Column 11, line 14, change "bytes" to --byte--;
line 18, change "vits" to --bits--
line 32, change "If, not" to --If not,--
line 42, change "key board" to --keyboard--;
line 43, delete "and display";
line 51, change "a" to --an--;
line 65, change "MHz." to --MHz--.
Column 12, line 3, before "therefore" insert a comma;
line 8, change "312" to --313--;
line 10, change "Do" to --DO--;
line 28, change "which" to --the specific--;
line 33, change "momory" to --memory--;
line 43, change "of" to --or--;
line 46, change "opration" to --operation--;
line 55, change "312" to --313--;
line 59, change "a" , second occurrence, to -- an --.
line 61, delete the comma;
line 69, change "communication" to --communications--.
Column 13, line 2, change "specially" to --especially--
line 2, change "and be" to --and to be--;
line 3, change "communication" to --communications--;
line 46, delete "will be performed";
line 59, insert a comma before "the"
line 66, change "illustrats" to --illustrated--.

UNITED STATES PATENT AND TRADEMARK OFFICE

CERTIFICATE OF CORRECTION

PATENT NO. : 4,747,600 Sheet 3 of 7

DATED : May 31, 1988

INVENTOR(S) : John Richardson

It is certified that error appears in the above-identified patent and that said Letters Patent is hereby corrected as shown below:

Column 14, line 2, change "communication" to --communications--;
line 8, change "arithmatic" to --arithmetic--;
line 34, change "impendance" to --impedance--;
line 64, change "keypresses" to --key presses--;
line 67, change "impendance" to --impedance--.
Column 15, line 28, change "LDCOSC" to --LCDOSC--;
line 32, after "inputs" insert --of--;
line 39, after "respectively" insert a comma;
line 40, delete "of";
line 45, after "364" insert a comma;
line 46, After "370" delete the comma
line 46, change "Vdd" to --$V_{DD}$--.
Column 16, line 14, change "Vdd" to --$V_{DD}$--;
line 41, change "keypress" to --key press--;
line 57, change "a" to --an--.
Column 17, line 9, after "and" insert --perform--;
lines 12-13, change "keypresses" to --key presses--;
line 22, after "validated" insert a comma;
line 50, after "another" insert --memory location--;
line 51, after "Further" insert a comma;
line 55, change "while" to a comma;
line 59, change "keypress" to --key press;
line 60, change "keypress" to --key press--.
Column 18, line 3, after "kept" insert a comma;
line 15, change "block" to --blocks--;
line 21, change "the" (first occurrence) to --a--;

UNITED STATES PATENT AND TRADEMARK OFFICE

CERTIFICATE OF CORRECTION

PATENT NO. : 4,747,600 Sheet 4 of 7

DATED : May 31, 1988

INVENTOR(S) : John Richardson

It is certified that error appears in the above-identified patent and that said Letters Patent is hereby corrected as shown below:

Column 18, line 21, delete "the" (second occurrence);
line 22, change "transfered to block" to --transferred to blocks--;
line 23, delete "back";
line 25, change "advice" to --device--;
line 31, change "the" (second occurrence) to --a--;
line 33, change "the" to --a--;
line 37, delete "the" (second occurrence);
line 56, delete ", being found,";
line 57, change "transfered" to --transferred--;
line 59, change "bystable" to --bistable--;
line 60, change "generated" to --transmitted--;
line 61, delete "a".

Column 19, line 25, change "and" to --; therefore,--;
line 56, change "communication" to --communications--;
line 61, after "program" insert --to--;
line 61, delete "to".

Column 20, line 4, change "keypress" to --key press--;
line 7, change "this" to --to--;
line 8, change "keypress" to --key press--;
line 15, change "in a" to --into another--;
line 17, change "keypress" to --key press--;
line 22, change "keypress" to --key press--;
line 27, change "and" to a semicolon;
line 37, change "218, 220, and 222" to --A218, A220, and A222--;
line 39, delete "are";
line 40, change "248" to --A248,--;

UNITED STATES PATENT AND TRADEMARK OFFICE

CERTIFICATE OF CORRECTION

PATENT NO. : 4,747,600 Sheet 5 of 7

DATED : May 31, 1988

INVENTOR(S) : John Richardson

It is certified that error appears in the above-identified patent and that said Letters Patent is hereby corrected as shown below:

Column 20, line 43, after "on" insert --the--;
line 53, change "transfered" to --transferred--;
line 67, after "space" insert a comma.
Column 21, line 5, after "player" insert a comma;
line 8, after "filled" insert a comma;
line 11, change "inputed" to --input--;
line 26, after "by" insert --a--;
line 34, change "and" to a semicolon;
line 42, delete the comma;
line 44, after "number" insert a comma;
line 54, delete "a";
line 55, delete "instead of a selected".
Column 22, line 2, change "A115" to --A150--;
line 12, change "transfering" to --transferring--;
line 22, change "for" to --on--;
line 24, change "transfering" to --transferring--;
line 27, after "key" insert a comma;
line 30, change "transfering" to --transferring--;
line 35, change "presses" to --press--;
lines 61-62, change A31-0-A318" to --A310-A318--;
line 69, change "form" to --from--.
Column 23, line 10, delete "being;
line 21, change "continously" to --continuously--;
line 27, change "block A326" to --blocks A326 and A328--;
line 31, after the comma insert --which--;
line 32, change "to" to --from--;
line 32, change ". The" to --, the--;
line 37, after "set" insert a comma;

UNITED STATES PATENT AND TRADEMARK OFFICE

CERTIFICATE OF CORRECTION

PATENT NO. : 4,747,600 Sheet 6 of 7

DATED : May 31, 1988

INVENTOR(S) : John Richardson

It is certified that error appears in the above-identified patent and that said Letters Patent is hereby corrected as shown below:

Column 23, line 38, change "being" to --begin--;
line 58, change "his" to --he--;
line 62, delete "either";
line 62, after "1" insert a comma.
Column 24, line 14, change "this" to --a--;
line 27, after "in" insert --block--
line 36, after "control" insert --is--;
line 37, change "A440" to --A448--;
line 52, after "by" insert --a--;
line 56, change "that number" to --both numbers--.
Column 25, line 1, change "Bingo Mode" to --BINGO mode--;
line 3, change "PDON" to --PDONE--;
line 7, change "by" to --. If--;
line 21, change "A" to --An--;
line 40, change "calltable" to --call table--;
line 43, change "labled" to --labeled--;
line 51, delete the comma;
line 55, change "control program is transfered" to --program control is transferred--.
Column 26, line 5, change "LDCOSC" to --LCDOSC--;
line 10, change "set up" to --setup--
line 14, change "set up" to --setup--
line 20, after "respectively" insert a comma;
line 20, change "tests" to --test--;
line 24, change "is" to --are--;
line 32, change "set up" to --setup--;
line 39, change "set up" to --setup--;
line 41, after "interrupt" insert a comma;

UNITED STATES PATENT AND TRADEMARK OFFICE

CERTIFICATE OF CORRECTION

PATENT NO. : 4,747,600 Sheet 7 of 7

DATED : May 31, 1988

INVENTOR(S) : John Richardson

It is certified that error appears in the above-identified patent and that said Letters Patent is hereby corrected as shown below:

Column 26, line 47, after "only" insert --one--;
line 67, after "or" insert --for input from--;
line 68, delete "to communicate with".

IN THE CLAIMS:

Column 27, line 55, change "indentical" to --identical--.
Column 28, line 15, change "more" to --mode--;
line 41, change "mean" to --means--.
Column 29, line 20, delete "a".
Column 31, line 22, delete "third";
line 24, after "a" insert --third--.
Column 32, line 14, change "retrievd" to --retrieved--;
line 26, change "a" to --an--.

Signed and Sealed this

Ninth Day of May, 1989

*Attest:*

*Attesting Officer*

DONALD J. QUIGG

*Commissioner of Patents and Trademarks*